US007138898B2

(12) United States Patent
Ishikawa

(10) Patent No.: US 7,138,898 B2
(45) Date of Patent: Nov. 21, 2006

(54) VARIABLE INDUCTOR

(75) Inventor: Hiroshi Ishikawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/378,261

(22) Filed: Mar. 20, 2006

(65) Prior Publication Data

US 2006/0220775 A1 Oct. 5, 2006

(30) Foreign Application Priority Data

Mar. 31, 2005 (JP) ..... 2005-102828

(51) Int. Cl.
*H01F 5/00* (2006.01)

(52) U.S. Cl. ..... 336/200; 333/181

(58) Field of Classification Search ..... 336/65, 336/115–116, 192, 200, 232; 333/181; 257/531; 335/78–84; 200/181
See application file for complete search history.

(56) References Cited

U.S. PATENT DOCUMENTS

| | | | | |
|---|---|---|---|---|
| 6,922,127 | B1 * | 7/2005 | Zou et al. | 336/200 |
| 7,042,319 | B1 * | 5/2006 | Ishiwata et al. | 335/78 |
| 7,071,806 | B1 * | 7/2006 | Masu et al. | 336/200 |
| 7,102,480 | * | 9/2006 | Bergstedt et al. | 336/232 |

FOREIGN PATENT DOCUMENTS

| | | |
|---|---|---|
| JP | 8-204139 | 8/1996 |

* cited by examiner

*Primary Examiner*—Tuyen T Nguyen
(74) *Attorney, Agent, or Firm*—Armstrong, Kratz, Quintos, Hanson & Brooks, LLP

(57) ABSTRACT

A variable inductor includes a conductor and an electroconductive member. The conductor has a coil and a pair of terminals electrically connected with the coil. The electroconductive member is movable closer to and farther away from the coil. The inductance between the terminals becomes smaller as the distance between the coil and the electroconductive member becomes shorter. Conversely, the inductance between the terminals becomes larger as the distance between the coil and the electroconductive member becomes longer.

9 Claims, 21 Drawing Sheets

VARIABLE INDUCTOR

BACKGROUND OF THE INVENTION

1. Field of the Invention

The present invention relates to a variable inductor incorporated e.g. in radio communications equipment.

2. Description of the Related Art

In the technical field of radio communications equipment such as mobile phones, there is an increasing requirement for smaller high-frequency circuits or RF circuits due to increase in the number of parts incorporated in the equipment for advanced features. In response to such a requirement, a variety of parts needed for building the circuitry are a focus of miniaturization using technologies called MEMS (micro-electromechanical systems). Inductors are a category of such parts. Inductors are an electronic part to be incorporated in electric circuits or electronic circuits, for use of an inductance provided by them, and sometimes there is a need for the inductance to be variable.

FIG. 30 and FIG. 31 show a primary configuration of an inductor X4 which is a conventional variable inductor whose inductance is variable. FIG. 30 is a plan view of the inductor X4 whereas FIG. 31 is a sectional view taken in lines XXXI—XXXI in FIG. 31.

The inductor X4 includes a substrate 91, a conductor 92 and a ferrite core 93. The conductor 92, which is formed on the substrate 91 using such technologies as thin-film formation and patterning technology, has an electroconductive coil 92*a* and a pair of terminals 92*b*. The ferrite core 93 has a high magnetic permeability and faces the coil 92*a*. Further, the ferrite core 93 is movable toward and away from the substrate 91 or the coil 92*a* within a predetermined range of movement. Such a variable inductor is disclosed in e.g. the following Patent Document 1.

Patent Document 1: JP-A-H08-204139

In the inductor X4, the ferrite core 93 is brought closer to the coil 92*a* in order to increase the inductance (self inductance) between the pair of terminals 92*b* in the inductor X4. When the ferrite core 93 is moved away from the coil 92*a*, the inductance is decreased. The coil's self inductance is known to be proportional to magnetic permeability in which the coil is placed. The closer is the distance between the ferrite core 93 and the coil 92*a*, higher is the net magnetic permeability in the environment around the coil 92*a* (and therefore higher is the net density of the magnetic flux generated around the coil 92*a* in association with an electric current flowing through the coil 92*a*), and so the inductance is higher.

However, in the inductor X4 whose inductance is varied by an advancing/retracting movement of a magnetically highly permeable member (the ferrite core 93) with respect to the coil 92*a*, the inductance can only be varied within a relatively small range of 10% approx, as mentioned in the Patent Document 1. Therefore, the inductor X4 is sometimes unable to vary its inductance as much as desired.

SUMMARY OF THE INVENTION

The present invention has been proposed under the above-described circumstances, and it is therefore an object of the present invention to provide a variable inductor suitable for inductance change over a wide range.

A variable inductor provided by the present invention includes: a conductor including a coil and a pair of terminals electrically connected with the coil; and an electroconductive member capable of moving closer to and farther away from the coil. An inductance between the terminals becomes smaller as a distance becomes shorter between the coil and the electroconductive member, and the inductance between the terminals becomes larger as the distance becomes longer between the coil and the electroconductive member. The inductance to be varied in the present variable inductor is a self inductance of the variable inductor, which is an inductance between the conductor terminals in the variable inductor that includes the conductor and the electroconductive member. Electrically, the coil is between the terminals and connected in series with each terminal. Further, the coil and the electroconductive member are spaced from each other by an appropriate distance. The description that the electroconductive member is capable of moving closer to and farther away from the coil means that the electroconductive member, which is located at a predetermined place, is capable of making a relative approach toward the coil, and that the electroconductive member, which is located at the predetermined place, is capable of making a relative retraction away from the coil.

In the present variable inductor, when an electric current is applied to the conductor via the terminals, the current causes a magnetic field (a first magnetic field) to be generated around the coil. The first magnetic field causes an induced current to flow in the electroconductive member, and the induced current causes a magnetic field (a second magnetic field) to be generated around the electroconductive member. The second magnetic field is formed to disturb the first magnetic field, i.e. to weaken the first magnetic field. In such an electromagnetic interference as the one between the coil and the electroconductive member, the following is true; the shorter the distance between the coil and the electroconductive member, the greater the induced current in the electroconductive member, the greater the second magnetic field, and therefore smaller the net magnetic field formed around the coil (In other words, the longer the distance between the coil and the electroconductive member, the smaller the induced current in the electroconductive member, the smaller the second magnetic field, and therefore greater the net magnetic field formed around the coil). The inventor et al. found: that the smaller the net magnetic field formed around the coil the smaller the inductance between the terminals; that the greater the net magnetic field formed around the coil, the greater the inductance between the terminals; and further, that rate of change in such an inductance change tends to be greater than in e.g. the inductor X4 where inductance is changed by advancing/retracting movement of a magnetically highly permeable member with respect to the coil. The variable inductor according to the present invention is based on these findings. A variable inductor which has a large rate of change in its inductance is suitable for varying the inductance over a wide range.

Preferably, the coil is provided by a flat spiral coil, and the electroconductive member is provided by an electroconductive film or an electroconductive plate which is spaced from the flat spiral coil in a thickness direction of the flat spiral coil and is faced by the flat spiral coil. Such an arrangement as the above is suitable for causing electromagnetic interference efficiently between the coil and the electroconductive member when electricity power is applied to the variable inductor.

Preferably, the electroconductive member extends in an in-plane direction of the flat spiral coil, beyond the flat spiral coil. Such an arrangement as the above is suitable for generating the induced current appropriately in the electroconductive member thereby achieving a large rate of inductance change.

According to a preferred embodiment of the present invention, the flat spiral coil has a center opening, and the electroconductive member has an opening at a place corresponding to the center opening. With this arrangement, preferably, the opening in the electroconductive member is within the center opening of the flat spiral coil as in an in-plane direction of the flat spiral coil. Such an arrangement as the above is suitable for generating the induced current intensively in the current carrying member, at a location faced by the flat spiral coil, thereby achieving a large rate of inductance change.

According to another preferred embodiment of the present invention, the flat spiral coil has a center opening, and the electroconductive member has a region which corresponds to the center opening and is provided with a projection. With this arrangement, preferably, the projection is made of an electroconductive material or a dielectric material.

Preferably, the electroconductive member is thicker than a skin depth of an induced current generated in the electroconductive member at the lowest frequency in a frequency range utilized. Such an arrangement as the above is suitable for generating the induced current appropriately in the electroconductive member thereby achieving a large rate of inductance change.

Preferably, the coil is made of Au, Cu, Al or Ni. Such an arrangement as the above is suitable for achieving a large rate of inductance change.

DETAILED DESCRIPTION OF THE PREFERRED EMBODIMENTS

Figure 1:
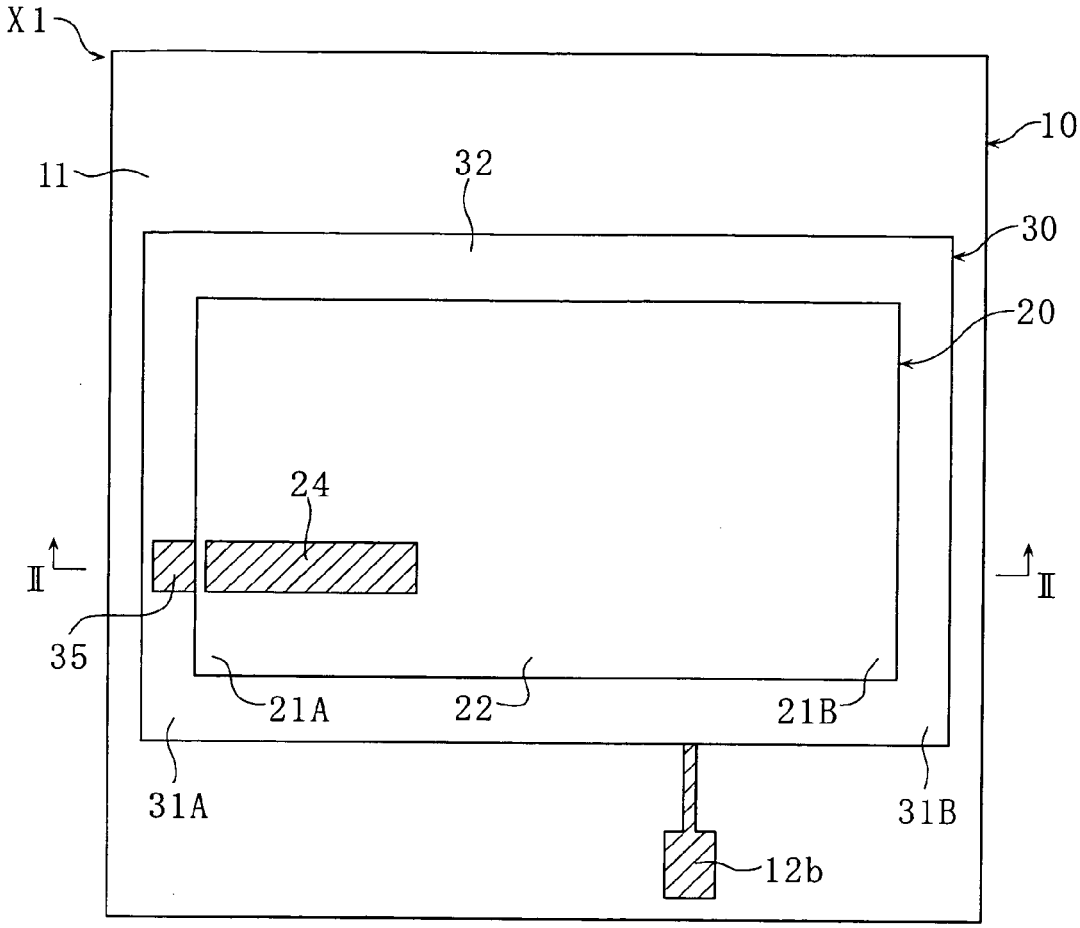
FIG. 1 is a top view of a variable inductor according to a first embodiment of the present invention.
Figure 2:
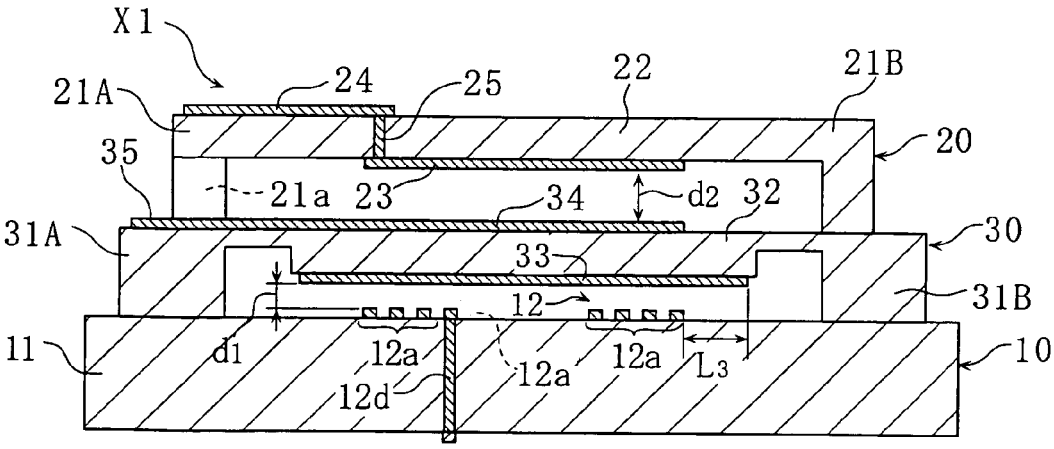
FIG. 2 is a sectional view taken in lines II—II in FIG. 1.

FIG. 1 and FIG. 2 show a variable inductor X1 according to a first embodiment of the present invention. FIG. 1 is a top view of the variable inductor X1 whereas FIG. 2 is a sectional view taken in lines II—II in FIG. 1.

The variable inductor X1 has a laminate structure including a first fixed structure 10, a second fixed structure 20 and a movable structure 30 between the two.

Figure 3:
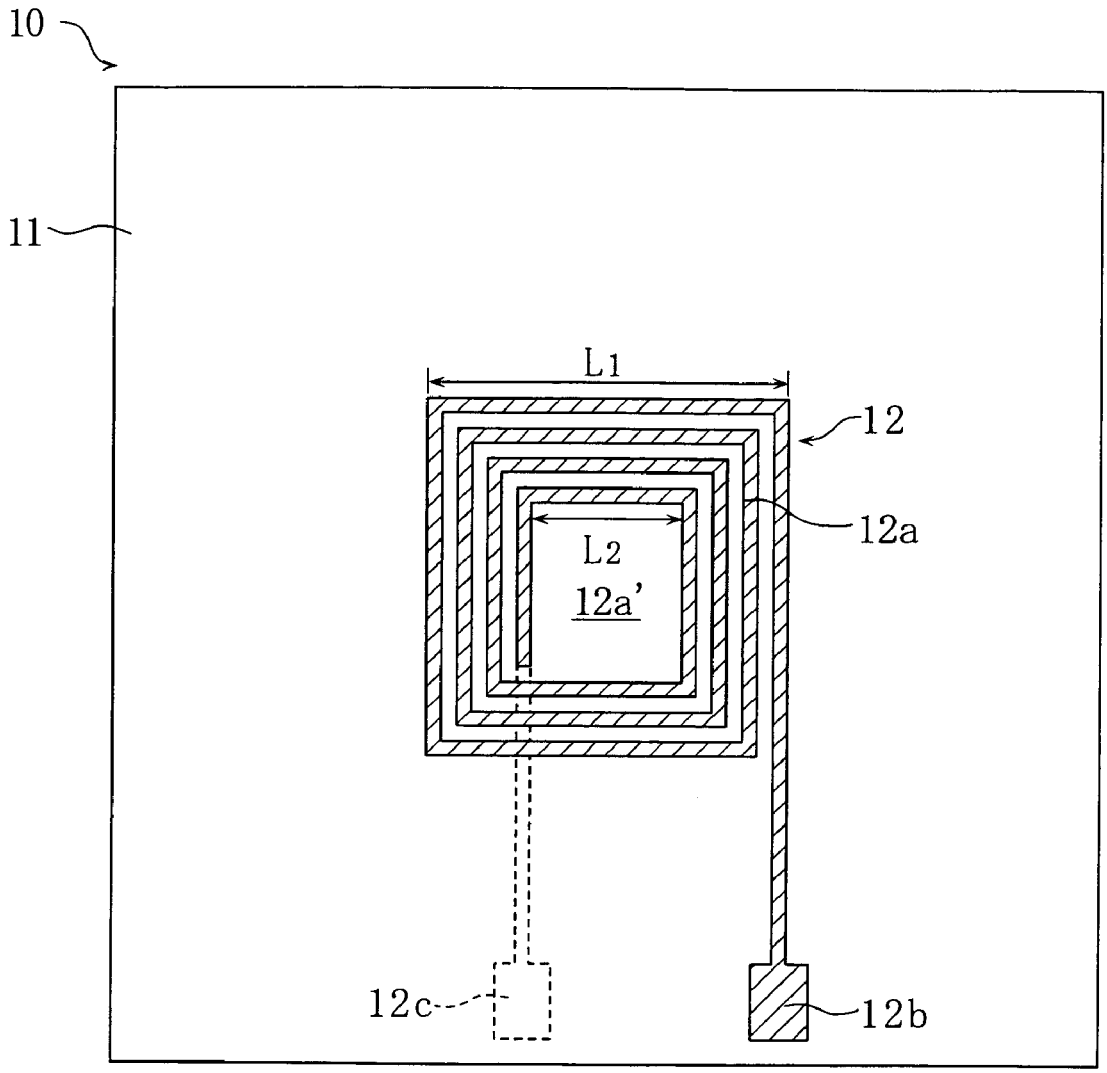
FIG. 3 is a top view of a first fixed structure of the variable inductor in FIG. 1.
Figure 4:
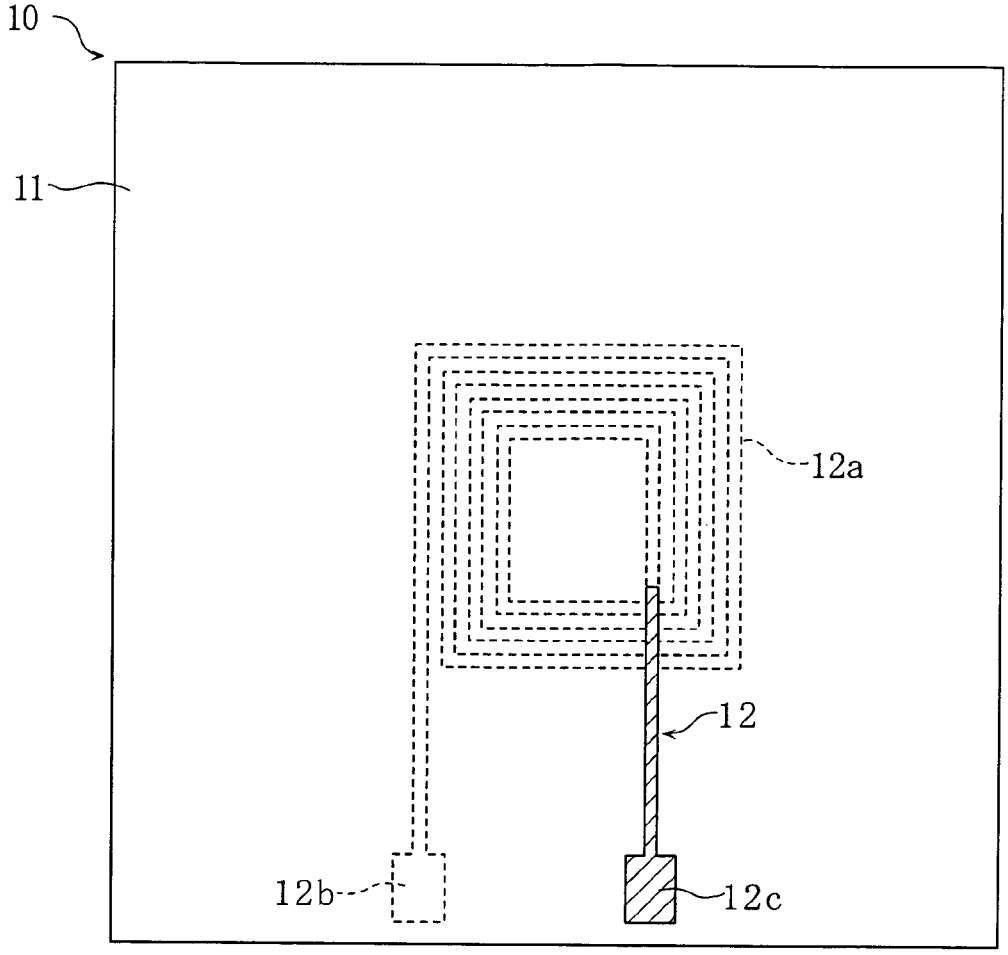
FIG. 4 is a bottom view of the first fixed structure of the variable inductor in FIG. 1.

As shown in FIG. 2 through FIG. 4, the first fixed structure 10 includes a base substrate 11 and a conductor 12. The base substrate 11 is made of a predetermined insulating material. The conductor 12 has: a coil 12*a* which has an opening 12*a'*; terminals 12*b*, 12*c*; and an electroconductive plug 12*d*. The coil 12*a* is a so called flat spiral coil. As shown in FIG. 3, the coil 12*a* and the terminal 12*b* are patterned on a surface of the base substrate 11 and are electrically connected with each other. Dimensionally, the coil 12*a* has a conductor width of e.g. 5 through 15 μm, a conductor thickness of e.g. 1 through 10 μm, a conductor-to-conductor distance of e.g. 5 through 15 μm, the number of windings of e.g. 3 through 5, a length $L_1$ (length of the side of the outermost square) indicated in FIG. 3 of e.g. 100 through 3000 μm, and a length $L_2$ (length of the side of the square opening 12*a'*) of e.g. 10 through 200 μm. As shown in FIG. 2, the terminal 12*c* is patterned on the other surface of the base substrate 11 as shown in FIG. 4, and is electrically connected with the coil 12*a* via an electroconductive plug 12*d* which penetrates the base substrate 11. Electrically, the coil 12*a* is between the terminals 12*b*, 12*c*, and has a series connection with each of the terminals 12*b*, 12*c*. The terminals 12*b*, 12*c* are connected with a predetermined circuit via a predetermined wiring (not illustrated). The conductor 12 as the above is made of a predetermined electrically conductive material. At least the coil 12*a* in the conductor 12 is made of Au, Cu, Al or Ni in the present embodiment.

Figure 5:
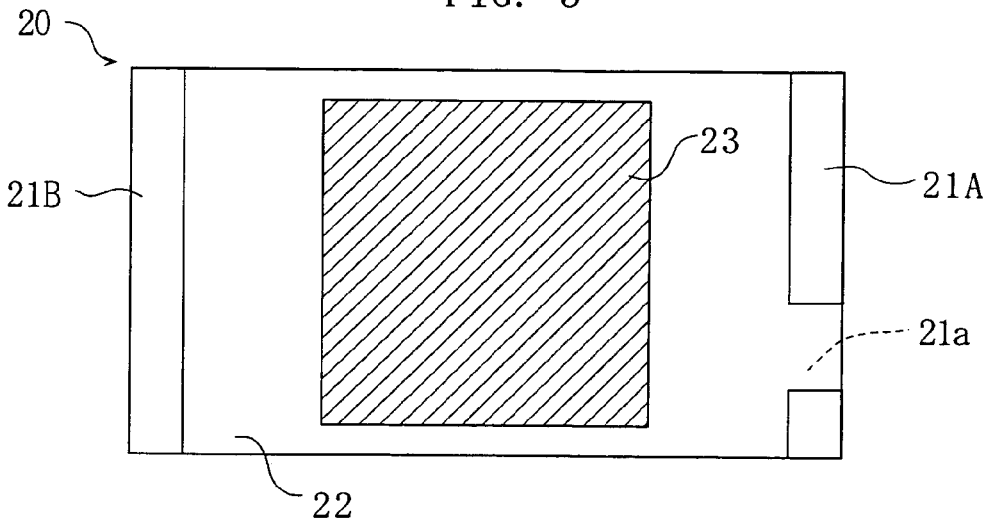
FIG. 5 is a bottom view of a second fixed structure of the variable inductor in FIG. 1.

As shown in FIG. 1, FIG. 2 and FIG. 5, the second fixed structure 20 includes a pair of bonding legs 21A, 21B, a fixed beam 22, a drive electrode 23, a terminal 24 and an electroconductive plug 25. As shown in FIG. 2 and FIG. 5, the bonding legs 21 have an escape 21*a*. The fixed beam 22 bridges the bonding legs 21A, 21B, and as shown in FIG. 2, is thinner than the bonding legs 21A, 21B. The drive electrode 23 is patterned on a surface of the fixed beam 22 as shown in FIG. 5. The terminal 24 is patterned on the other surface of the fixed beam 22 as shown in FIG. 1, and is electrically connected with the drive electrode 23 via the electroconductive plug 25 which penetrates the fixed beam 22 as shown in FIG. 2. The bonding legs 21A, 21B and the fixed beam 22 are made of a predetermined insulating material. The drive electrode 23, the terminal 24, and the electroconductive plug 25 are each made of a predetermined electroconductive material.

Figure 6:
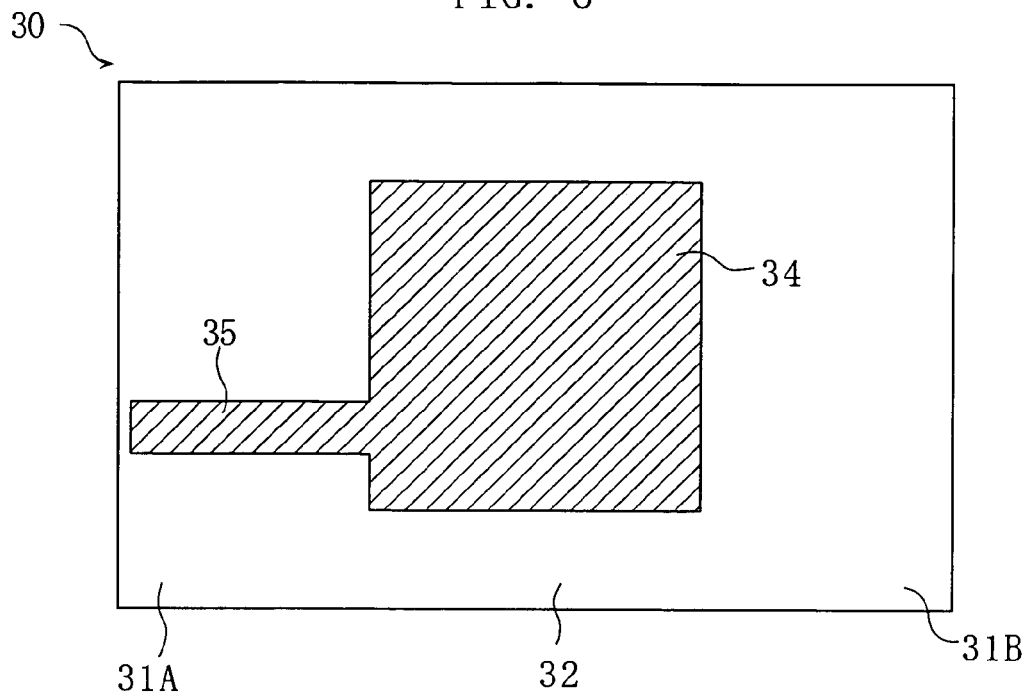
FIG. 6 is a top view of a movable structure of the variable inductor in FIG. 1.
Figure 7:
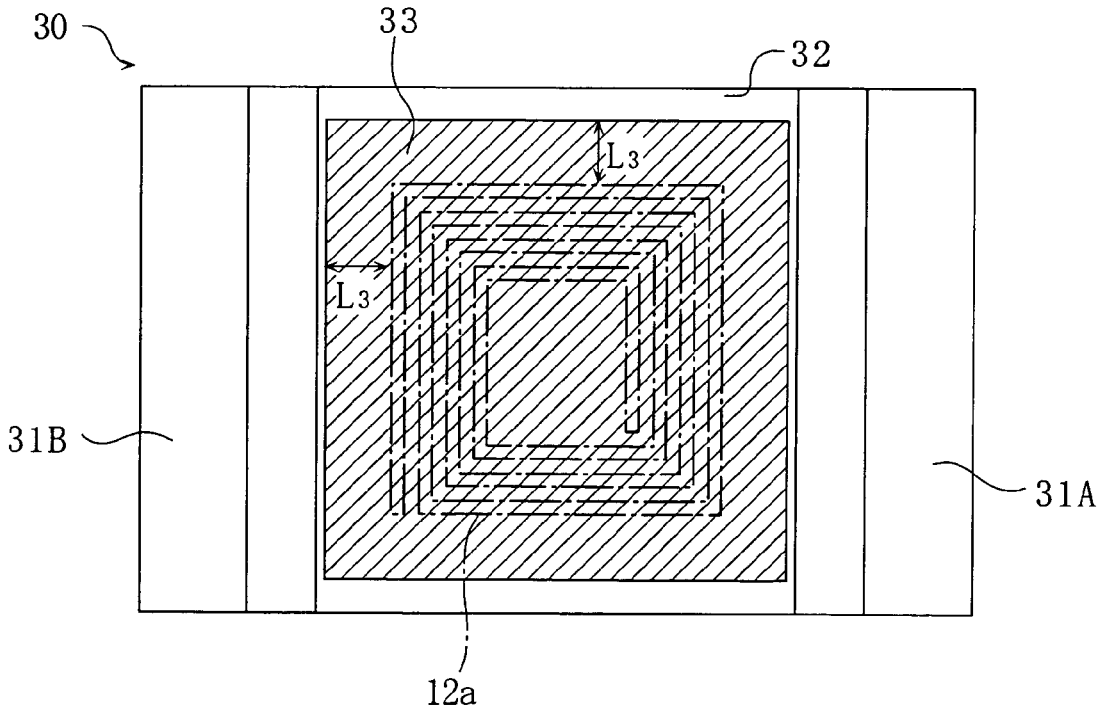
FIG. 7 is a bottom view of the movable structure of the variable inductor in FIG. 1, with a coil of the first fixed structure drawn in phantom lines.

As shown in FIG. 2, FIG. 6 and FIG. 7, the movable structure 30 includes a pair of bonding legs 31A, 31B, a movable beam 32, an electroconductive film 33, a drive electrode 34 and a terminal 35. As shown in FIG. 2, the bonding legs 31A, 31B are wider than the bonding legs 21A, 21B of the second fixed structure 20. The movable beam 32 bridges the bonding legs 31A, 31B, and as shown in FIG. 2, is thinner than the bonding legs 31A, 31B. The electroconductive film 33 is patterned on a surface of the movable beam 32 as shown in FIG. 7, and faces the coil 12*a* of the first fixed structure 10 as shown in FIG. 2. The electroconductive film 33 extends in in-plane directions of the coil 12*a*, beyond the coil 12*a*. In an in-plane direction of the coil 12*a*, a distance $L_3$ as in FIG. 2 and FIG. 7 between an outermost edge of the electroconductive film 33 and an outermost edge of the coil 12*a* is e.g. 0 through 200 μm. The coil 12*a* is spaced from the electroconductive film 33 by a distance $d_1$, which is e.g. 0.2 through 2 μm when the movable beam 32 is in the natural state (i.e. when not in operation). The electroconductive film 33 such as the above has a thickness of e.g. 1 through 10 μm. The drive electrode 34 is patterned on the other surface of the movable beam 32 as shown in FIG. 6, and faces the drive electrode 23 formed in the second fixed structure 20. The drive electrodes 23, 34 are spaced from each other by a distance $d_2$, which is e.g. 20 through 60 μm when the movable beam 32 is in the natural state. The terminal 35 is patterned on the same side as the drive electrode 34, on the movable beam 32 and the bonding legs 31A, as shown in FIG. 6, and is electrically connected with the drive electrode 34. As shown in FIG. 2, the terminal 35 extends to pass through the escape 21*a* of the bonding leg 21A in the second fixed structure 20. The terminal 35 such as the above is electrically grounded via a predetermined wiring (not illustrated). The bonding legs 31A, 31B and the movable beam 32 are made of a predetermined insulating material. The electroconductive film 33 is made of e.g. Al, Cu, Au and Ni. The drive electrode 34 and the terminal 35 are each made of a predetermined electroconductive material.

The variable inductor X1 being thus far described as the above, when a predetermined electrical potential is applied to the drive electrode 23 via the terminal 24 and the electroconductive plug 25, an electrostatic pull is generated between the drive electrodes 23, 34. The pull causes the movable beam 32 to deform elastically, coming closer to the fixed beam 22 thereby increasing the distance $d_1$ between the coil 12*a* the electroconductive film 33. By adjusting the electric potential to be applied to the drive electrode 23, it is possible to control the electrostatic pull between the drive electrodes 23, 34, to control the amount of dislocation of the movable beam 32, and therefore to control the distance $d_1$ between the coil 12*a* and the electroconductive film 33.

In the variable inductor X1, when an electric current is applied to the conductor 12 via the terminals 12*b*, 12*c*, the current causes a magnetic field (a first magnetic field) to be generated around the coil 12*a*. The first magnetic field causes an induced current to flow in the electroconductive film 33, and the induced current causes a magnetic field (a second magnetic field) to be generated around the electroconductive film 33. The second magnetic field is formed to disturb the first magnetic field, i.e. to weaken the first magnetic field. In such an electromagnetic interference as the one between the coil 12*a* and the electroconductive film 33, the following is true; the shorter the distance $d_1$ between the coil 12*a* and the electroconductive film 33, the greater the induced current in the electroconductive film 33, the greater the second magnetic field, and therefore smaller the net magnetic field formed around the coil 12*a* (In other words, the longer the distance $d_1$, the smaller the induced current in the electroconductive film 33, the smaller the second magnetic field, and therefore greater the net magnetic field formed around the coil 12*a*). The smaller the net magnetic field formed around the coil 12*a* (i.e. shorter the distance $d_1$), the smaller the inductance between the terminals 12*b*, 12*c*: The greater the net magnetic field formed around the coil 12*a* (i.e. longer the distance $d_1$), the greater the inductance between the terminals 12*b*, 12*c*. Rate of change in such an inductance change tends to be greater than in e.g. the inductor X4 where inductance is changed by advancing/retracting movement of a magnetically highly permeable member with respect to the coil (Inductance of the variable inductor X1 can be adjusted by adjusting the distance $d_1$). The variable inductor X1 which has a large rate of change in its inductance is suitable for varying the inductance over a wide range.

In the variable inductor X1, the electroconductive film 33 extends in in-plane directions of the coil 12*a*, beyond the coil 12*a* as described earlier. Such an arrangement enables to generate the above-mentioned induced current appropriately in the electroconductive film 33, at a location faced by the coil 12*a*. Therefore, such an arrangement is suitable for achieving a large rate of inductance change.

It is preferable that the electroconductive film 33 should have a thickness which is not smaller than a skin depth of the induced current generated in the electroconductive film 33 at the lowest frequency of the frequency range used in the variable inductor X1. Such an arrangement is suitable for generating the induced current appropriately in the electroconductive film 33 and for achieving a large rate of inductance change. The skin depth δ[m] in the electroconductive film 33, of an induced current (AC) generated in the electroconductive film 33 when an AC current is applied to the conductor 12 is expressed in the following Formula (1). In the case of electroconductive film 33 of the variable inductor X1, ρ in Formula (1) represents resistivity [Ω m] of the electroconductive film 33, μ represents magnetic permeability [H/m] of the electroconductive film 33, and ω represents angular frequency of the induced current (AC) which is equal to 2πf (f: induced current frequency [Hz]). In order to generate the induced current appropriately in the electroconductive film 33, the electroconductive film 33 should have a thickness which is not smaller than the induced current skin depth δ so as not to inhibit the induced current.

$$\delta = \sqrt{\frac{2\rho}{\omega\mu}} \tag{1}$$

Figure 8:
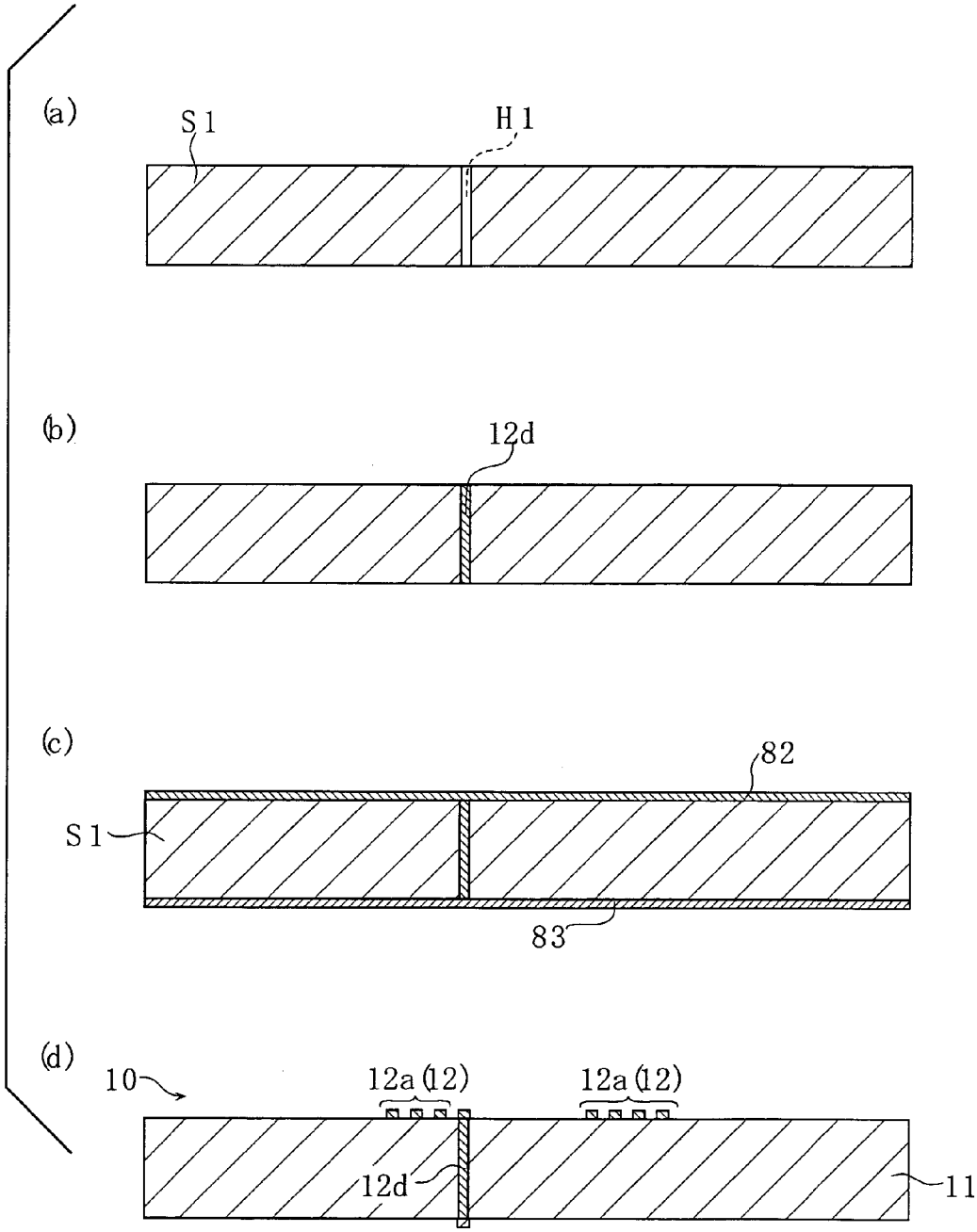
FIG. 8 shows a method of making the first fixed structure.
Figure 9:
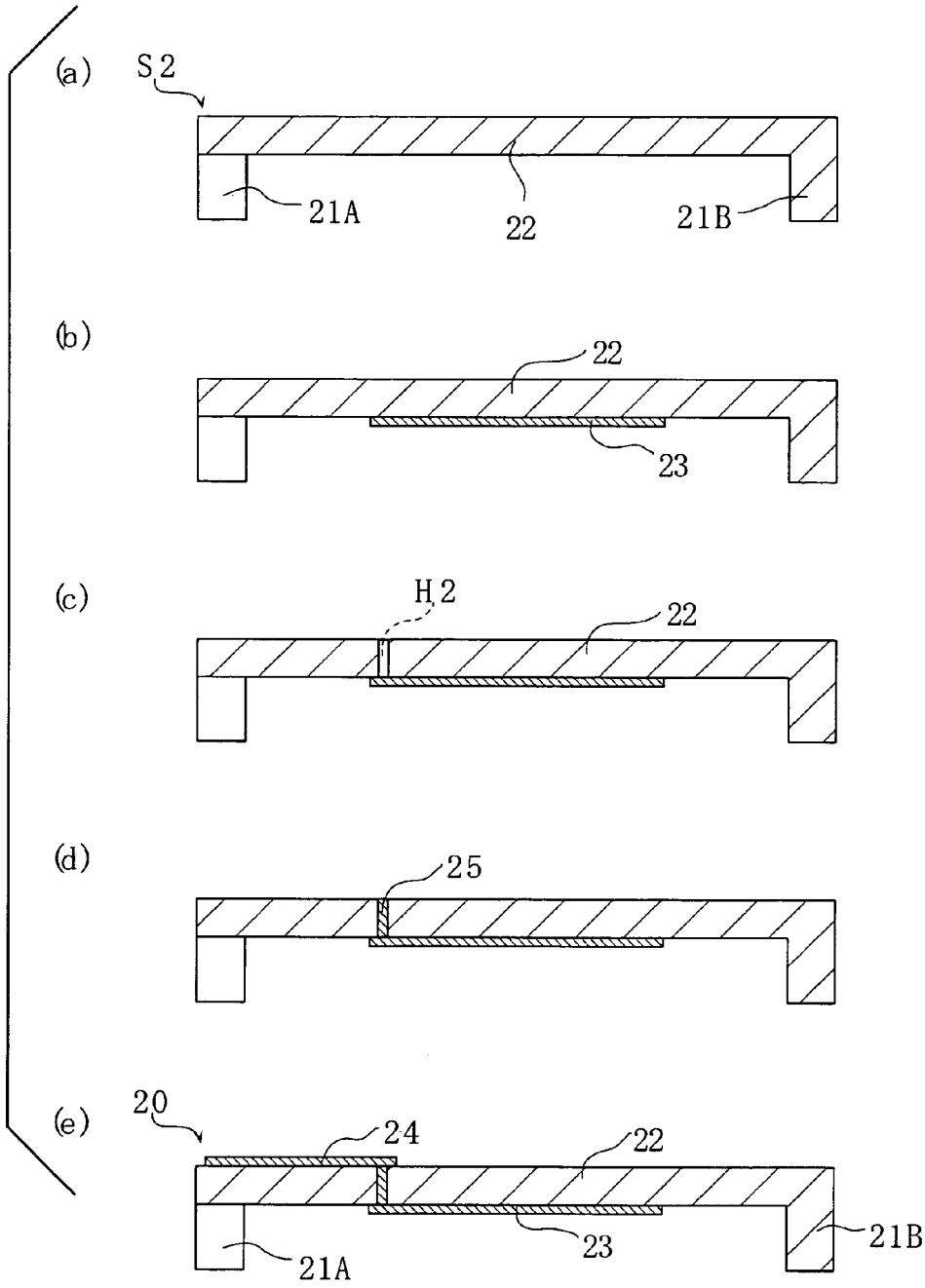
FIG. 9 shows a method of making the second fixed structure.
Figure 10:
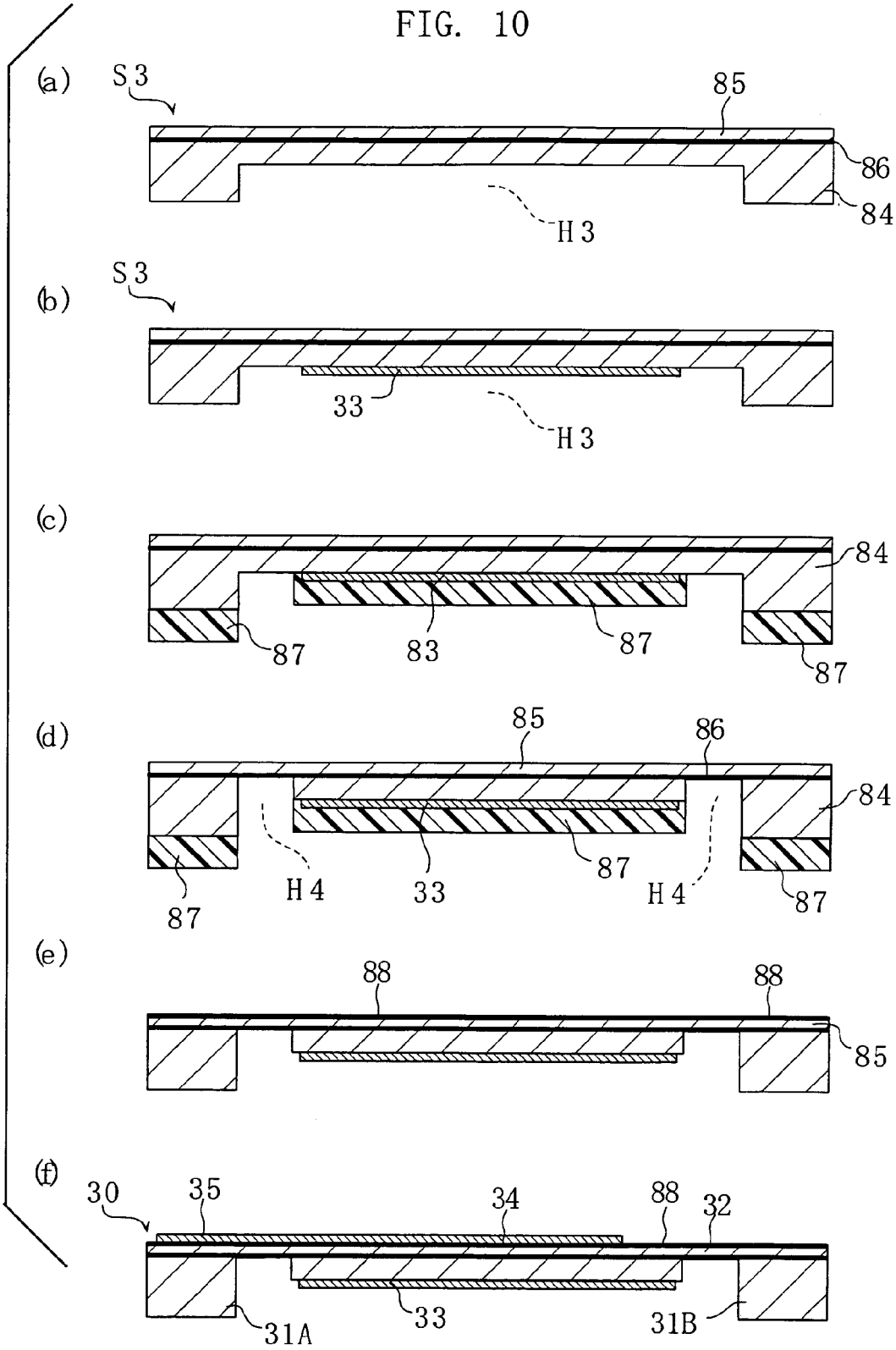
FIG. 10 shows a method of making the movable structure.
Figure 11:
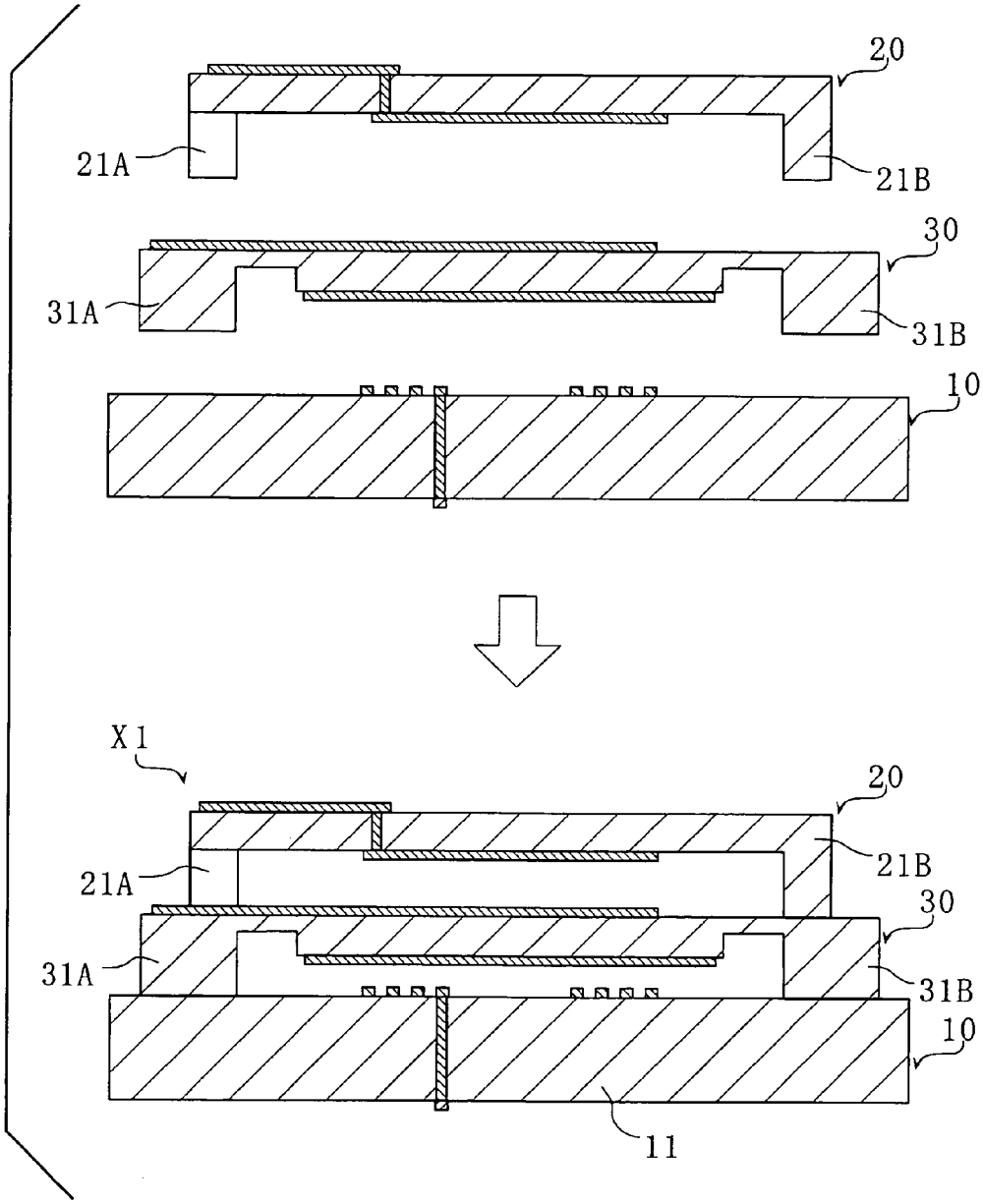
FIG. 11 shows a step of bonding the first fixed structure, the second fixed structure and the movable structure.

FIG. 8 through FIG. 11 show a method of manufacturing the variable inductor X1. FIG. 8 shows a method of making the first fixed structure 10, FIG. 9 shows a method of making the second fixed structure 20, FIG. 10 shows a method of making the movable structure 30, and FIG. 11 shows a step of bonding these first fixed structure 10, the second fixed structure 20 and the movable structure 30.

In manufacturing the first fixed structure 10, first, as shown in FIG. 8(*a*), a through hole H1 for formation of an electroconductive plug 12*d* is formed in a substrate S1. Specifically, an anisotropic etching process is performed to the substrate S1 using a mask provided by a predetermined resist pattern (not illustrated) formed on the substrate S1 whereby the through hole H1 is formed in the substrate S1. The substrate S1 is made of e.g. single-crystal silicon and will serve as a base substrate 11. The anisotropic etching process can be provided by DRIE (deep reactive ion etching). In DRIE, good anisotropic etching is achievable in a Bosch process in which etching and side-wall protection are alternated with each other.

Next, as shown in FIG. 8(*b*), a predetermined electroconductive material is filled in the through hole H1 to form the electroconductive plug 12*d*. The electroconductive material can be supplied into the through hole H1 by spattering method or CVD method. The resist pattern which was used as the mask when forming the through hole H1 is removed after the present step is finished.

Next, as shown in FIG. 8(*c*), electroconductive films 82, 83 are formed by forming films of a predetermined electroconductive material on the substrate S1 using e.g. spattering method. Thereafter, as shown in FIG. 8(*d*), part of a conductor 12 is formed from the electroconductive films 82, 83. Specifically, an etching process is performed to the electroconductive films 82, 83 using a mask provided by a predetermined resist pattern (not illustrated) formed on the electroconductive film 82, 83 whereby part of the conductor 12 including a coil 12*a* and terminals 12*b*, 12*c* is patterned on the substrate S1. The etching process can be provided by wet etching. Through the above-described step, a first fixed structure 10 including a base substrate 11 and a conductor 12 can be manufactured.

In manufacturing of the second fixed structure 20, first, as shown in FIG. 9(*a*), bonding legs 21A, 21B and a fixed beam 22 are formed on a substrate S2. Specifically, using a mask provided by a predetermined resist pattern (not illustrated) formed on the substrate S2, an anisotropic etching process is performed to the substrate S2 until a predetermined depth is reached whereby the substrate S2 is formed with the bonding legs 21A, 21B and the fixed beam 22. The substrate S2 is made of e.g. single-crystal silicon. The anisotropic etching process can be provided by DRIE.

Next, as shown in FIG. 9(*b*), a drive electrode 23 is formed on the fixed beam 22. Specifically, a predetermined electroconductive film is formed on the substrate S2, and then an etching process is performed to the electroconductive film using a mask provided by a predetermined resist pattern (not illustrated) formed on the electroconductive film whereby the drive electrode 23 is patterned.

Next, as shown in FIG. 9(*c*), a through hole H2 for formation of an electroconductive plug 25 is formed in a fixed beam 22. Specifically, an anisotropic etching process is performed to the substrate S2 using a mask provided by a predetermined resist pattern (not illustrated) formed on the substrate S2 whereby the through hole H2 is formed in the fixed beam 22 of the substrate S2. The anisotropic etching process can be provided by DRIE.

Next, as shown in FIG. 9(*d*), a predetermined electroconductive material is filled in the through hole H2 to form the electroconductive plug 25. The electroconductive material can be supplied into the through hole H2 by spattering method or CVD method. The resist pattern which was used as the mask when forming the through hole H2 is removed after the present step is finished.

Next, as shown in FIG. 9(*e*), a terminal 24 is formed on the fixed beam 22 and bonding legs 21A. Specifically, a predetermined electroconductive film is formed on the fixed beam 22 and the bonding leg 21A. Then, using a mask provided by a predetermined resist pattern (not illustrated) formed on the electroconductive film, an etching process is performed to the electroconductive film whereby the terminal 24 is patterned. Through the above-described step, a second fixed structure 20 can be manufacture which includes a pair of bonding legs 21A, 21B, a fixed beam 22, a drive electrode 23, a terminal 24, and an electroconductive plug 25.

In manufacturing of the movable structure 30, first, as shown in FIG. 10(*a*), a recess H3 is formed in a substrate S3. Specifically, using a mask provided by a predetermined resist pattern (not illustrated) formed on the substrate S3, an anisotropic etching process is performed to the substrate S3 until a predetermined depth is reached whereby the substrate S3 is formed with the recess H3. The substrate S3 is a so called SOI (Silicon on Insulator) substrate, and has a laminate structure including silicon layers 84, 85 and a silicon-oxide layer 86 between the silicon layers. The anisotropic etching process used in the present step can be DRIE.

Next, as shown in FIG. 10(*b*), the electroconductive film 33 is formed on the bottom of the recess H3. Specifically, a predetermined electroconductive material is formed on the bottom of the recess H3. Thereafter, using a mask provided by a predetermined resist pattern (not illustrated) formed on the film, an etching process is performed whereby the electroconductive film 33 is patterned.

Next, a resist pattern 87 as shown in FIG. 10(*c*) is formed. Thereafter, using the resist pattern 87 as a mask, an anisotropic etching process is performed to the silicon layer 84 until the silicon-oxide layer 86 is reached whereby the recess H4 is formed as shown in FIG. 10(*d*). The anisotropic etching can be provided by DRIE.

Next, the resist pattern 87 is removed, and then as shown in FIG. 10(*e*), an oxide film 88 is formed on the silicon layer 85. The oxide film 88 can be formed through e.g. a thermal oxidation process on the surface of the silicon layer 85.

Next, as shown in FIG. 10(*f*), a drive electrode 34 and a terminal 35 are formed on the oxide film 88. Specifically, a predetermined electroconductive film is formed on the oxide film 88. Thereafter, using a mask provided by a predetermined resist pattern (not illustrated) formed on the electroconductive film, an etching process is performed to the electroconductive film whereby the drive electrode 34 and the terminal 35 are patterned. Through the above-described step, a movable structure 30 is manufactured which includes a pair of bonding legs 31A, 31B, a movable beam 32, an electroconductive film 33, a drive electrode and a terminal 35.

In the manufacture of the variable inductor X1, the first fixed structure 10, the second fixed structure 20, and the movable structure 30 thus far produced are bonded together as shown in FIG. 11. Specifically, first, bonding is made between the base substrate 11 of the fixed structure 10 and the bonding legs 31A, 31B of the movable structure 30 whereas bonding is also made between the bonding legs 31A, 31B of the movable structure 30 and the bonding legs 21A, 21B of the fixed structure 20. Examples of usable bonding means include direct bonding, eutectic bonding, polymer bonding, bonding with glass, epoxy and other adhesives. Following the steps described, it is possible to make a variable inductor X1 which includes a first fixed structure 10, a second fixed structure 20 and a movable structure.

Figure 12:
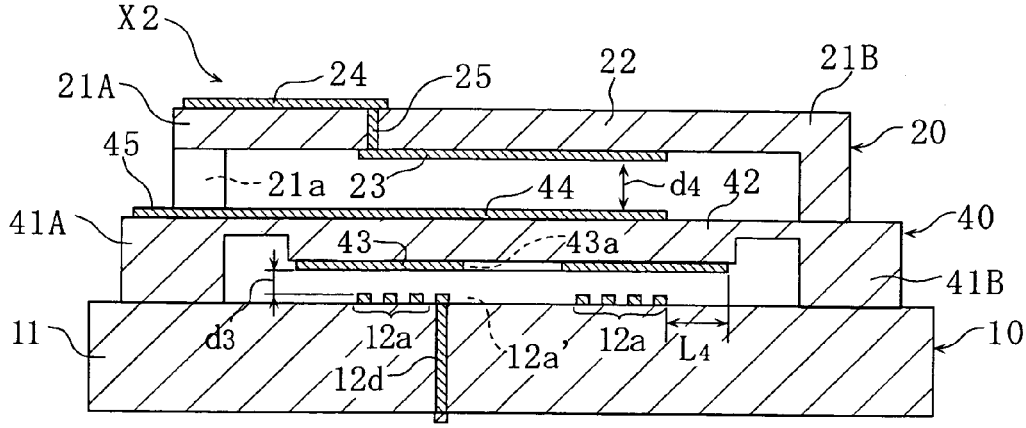
FIG. 12 is a sectional view of a variable inductor according to a second embodiment of the present invention. The figure is comparable to FIG. 2 which is a sectional view of the variable inductor according to the first embodiment.

FIG. 12 is a sectional view of a variable inductor X2 according to a second embodiment of the present invention. The figure is comparable to the sectional view of the variable inductor X1 in FIG. 2. The variable inductor X2 has a laminate structure including a first fixed structure 10, a second fixed structure 20 and a movable structure 40 between the two. The variable inductor X2 differs from the variable inductor X1 in that it includes a movable structure 40 in place of the movable structure 30.

Figure 13:
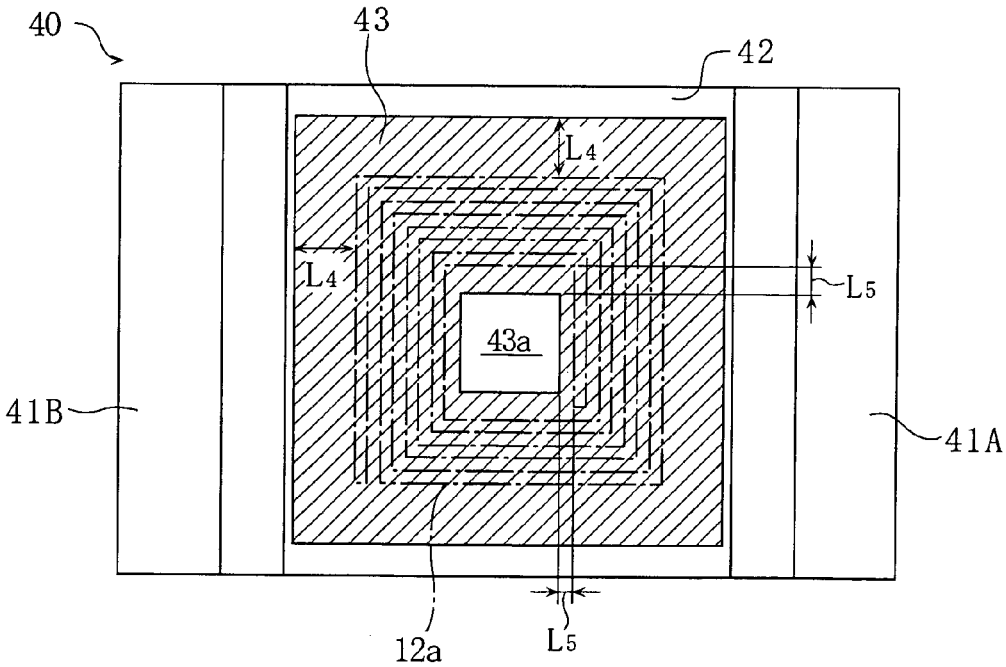
FIG. 13 is a bottom view of a movable structure according to the second embodiment.

As shown in FIG. 12 and FIG. 13, the movable structure 40 includes: a pair of bonding legs 41A, 41B; a movable beam 42; an electroconductive film 43 having an opening 43*a*; a drive electrode 44; and a terminal 45. The bonding legs 41A, 41B are wider than the bonding legs 21A, 21B of the second fixed structure 20. The movable beam 42 bridges the bonding legs 41A, 41B, and is thinner than the bonding legs 41A, 41B. The electroconductive film 43 is patterned on a surface of the movable beam 42, and faces the coil 12*a* of the first fixed structure 10. The electroconductive film 43 extends in in-plane directions of the coil 12*a*, beyond the coil 12*a*. In an in-plane direction of the coil 12*a*, a distance $L_4$ as indicated in FIG. 12 and FIG. 13, between an outermost edge of the electroconductive film 43 and an outermost edge of the coil 12*a* is e.g. 0 through 200 μm. The electroconductive film 43 has an opening 43*a* which lies within an opening 12*a'* of the coil 12*a* as in an in-plane direction of the coil 12*a*. In an in-plane direction of the coil 12*a*, a distance $L_5$ indicated in FIG. 13, between an innermost edge of the electroconductive film 43 and an innermost edge of the coil 12*a* is e.g. 0 through 90 μm. A distance $d_3$ between the coil 12*a* and the electroconductive film 43 is e.g. 0.2 through 2 μm when the movable beam 42 is in the natural state (when not operated). The electroconductive film 43 as the above has a thickness of e.g. 1 through 10 μm. The drive electrode 44 is patterned on the other surface of the movable beam 42, and faces the drive electrode 23 of the second fixed structure 20. A distance $d_4$ between the drive electrodes 23, 44 is e.g. 20 through 60 μm when the movable beam 42 is in the natural state. The terminal 45 is patterned on the same side of the drive electrode 44, on the movable beam 42 and the bonding legs 41A, being electrically connected with the drive electrode 44. The terminal 45 extends through the escape 21*a* of the bonding leg 21A in the second fixed structure 20. The terminal 45 such as the above is electrically grounded via a predetermined wiring (not illustrated). The bonding legs 41A, 41B and the movable beam 42 are made of a predetermined insulating material. The electroconductive film 43 is made of e.g. Al, Cu, Au and Ni. The drive electrode 44 and the terminal 35 are each made of a predetermined electroconductive material.

The variable inductor X2 being thus far described as the above, when a predetermined electrical potential is applied to the drive electrode 23 via the terminal 24 and the electroconductive plug 25, an electrostatic pull is generated between the drive electrodes 23, 44. The pull causes the movable beam 42 to deform elastically, coming closer to the fixed beam 22 thereby increasing the distance $d_3$ between the coil 12*a* and the electroconductive film 43. By adjusting the electric potential to be applied to the drive electrode 23, it is possible to control the electrostatic pull between the drive electrodes 23, 44, to control the amount of dislocation of the movable beam 42, and therefore to control the distance $d_3$ between the coil 12*a* and the electroconductive film 43.

In the variable inductor X2, when an electric current is applied to the conductor 12 via the terminals 12*b*, 12*c*, the current causes a magnetic field (a first magnetic field) to be generated around the coil 12*a*. The first magnetic field causes an induced current to flow in the electroconductive film 43, and the induced current causes a magnetic field (a second magnetic field) to be generated around the electroconductive film 43. The second magnetic field is formed to disturb the first magnetic field, i.e. to weaken the first magnetic field. In such an electromagnetic interference as the one between the coil 12*a* and the electroconductive film 43, the following is true; the shorter the distance $d_3$ between the coil 12*a* and the electroconductive film 43, the greater the induced current in the electroconductive film 43, the greater the second magnetic field, and therefore smaller the net magnetic field formed around the coil 12*a* (In other words, the longer the distance $d_3$, the smaller the induced current in the electroconductive film 43, the smaller the second magnetic field, and therefore greater the net magnetic field formed around the coil 12*a*). The smaller the net magnetic field formed around the coil 12*a* (i.e. shorter the distance $d_3$), the smaller the inductance between the terminals 12*b*, 12*c*: The greater the net magnetic field formed around the coil 12*a* (i.e. longer the distance $d_3$), the greater the inductance between the terminals 12*b*, 12*c*. Rate of change in such an inductance change tends to be greater than in e.g. the inductor X4 where inductance is changed by advancing/retracting movement of a magnetically highly permeable member with respect to the coil (Inductance of the variable inductor X2 can be adjusted by adjusting the distance $d_1$). The variable inductor X2 which has a large rate of change in its inductance is suitable for varying the inductance over a wide range.

In the variable inductor X2, the electroconductive film 43 extends in in-plane directions of the coil 12*a*, beyond the coil 12*a* as described earlier. Such an arrangement enables to generate the above-mentioned induced current appropriately in the electroconductive film 43, at a location faced by the coil 12*a*. Therefore, such an arrangement is suitable for achieving a large rate of inductance change.

In the variable inductor X2, the opening 43*a* of the electroconductive film 43 lies within the opening 12*a'* of the coil 12*a* as in an in-plane direction of the coil 12*a*, as described earlier. Such an arrangement is suitable for generating the induced current intensively in the electroconductive film 43, at a location faced by the coil 12*a*. Therefore, such an arrangement is suitable for achieving a large rate of inductance change.

In the variable inductor X2, it is preferable that the electroconductive film 43 should have a thickness which is not smaller than a skin depth of the induced current generated in the electroconductive film 43 at the lowest frequency of the frequency range used in the variable inductor X2. Such an arrangement is suitable for generating the induced current appropriately in the electroconductive film 43 and for achieving a large rate of inductance change.

Figure 14:
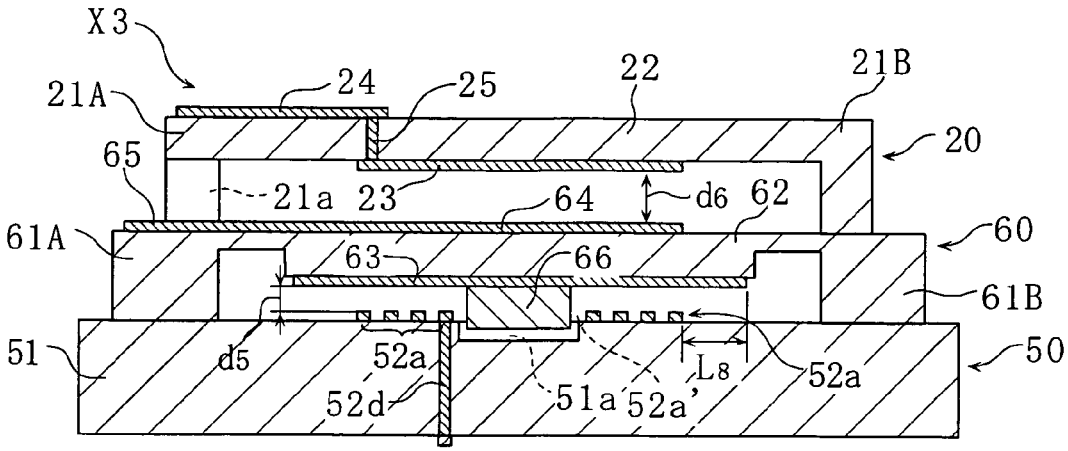
FIG. 14 is sectional view of a variable inductor according to a third embodiment of the present invention. The figure is comparable to FIG. 2 which is a sectional view of the variable inductor according to the first embodiment.

FIG. 14 is a sectional view of a variable inductor X3 according to a third embodiment of the present invention. The figure is comparable to the sectional view in FIG. 2 of the variable inductor X1. The variable inductor X3 has a laminate structure including a first fixed structure 50, a second fixed structure 20 and a movable structure 60 between the two. The variable inductor X3 differs from the variable inductor X1 in that it includes the first fixed structure 50 and the movable structure 60 in place of the first fixed structure 10 and the movable structure 30.

Figure 15:
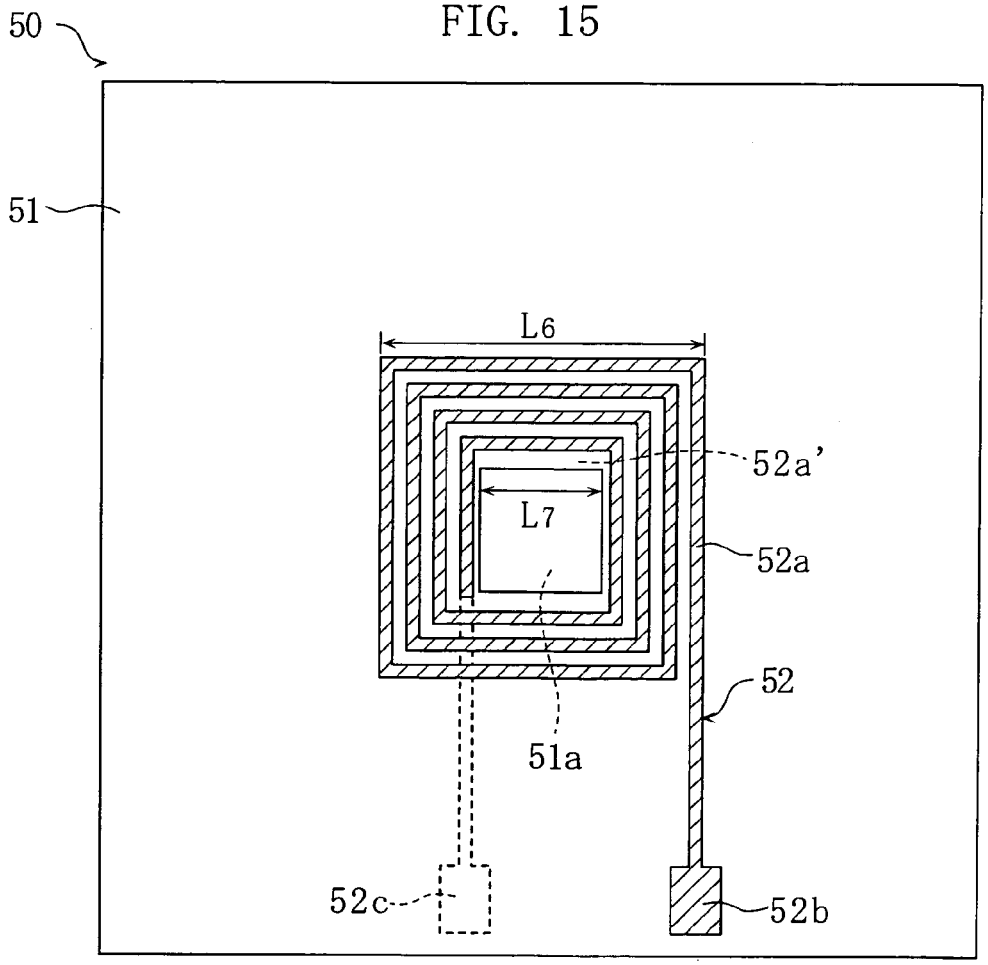
FIG. 15 is a top view of a first fixed structure according to the third embodiment.

As shown in FIG. 14 and FIG. 15, the first fixed structure 50 includes a base substrate 51 and a conductor 52. The base substrate 51 is made of a predetermined insulating material. The conductor 52 has: a coil 52*a* which has an opening 52*a'*; terminals 52*b*, 52*c*; and an electroconductive plug 52*d*. The coil 52*a* is a so called flat spiral coil. The coil 52*a* and the terminal 52*b* are patterned on a surface of the base substrate 51 and are electrically connected with each other. Dimensionally, the coil 52*a* has a conductor width of e.g. 5 through 15 μm, a conductor thickness of e.g. 1 through 10 μm, a conductor-to-conductor distance of e.g. 5 through 15 μm, the number of windings of e.g. 3 through 5, and a length $L_6$ (length of the side of the outermost square) shown in FIG. 15 of e.g. 100 through 3000 μm. The coil 52*a* as described has an opening 52*a'*, which is faced by a recess 51*a* formed in the base substrate 51. The recess 51*a* has a length $L_7$ as indicated in FIG. 15, of e.g. 10 through 200 μm. The terminal 52*c* is patterned on the other surface of the base substrate 51, and is electrically connected with the coil 52*a* via an electroconductive plug 52*d* which penetrates the base substrate 51. Electrically, the coil 52*a* is between the terminals 52*b*, 52*c*, and has a series connection with each of the terminals 52*b*, 52*c*. The terminals 52*b*, 52*c* are connected with a predetermined circuit via a predetermined wiring (not illustrated). The conductor 52 as the above is made of a predetermined electrically conductive material. At least the coil 52*a* in the conductor 52 is made of Au, Cu, Al or Ni.

Figure 16:
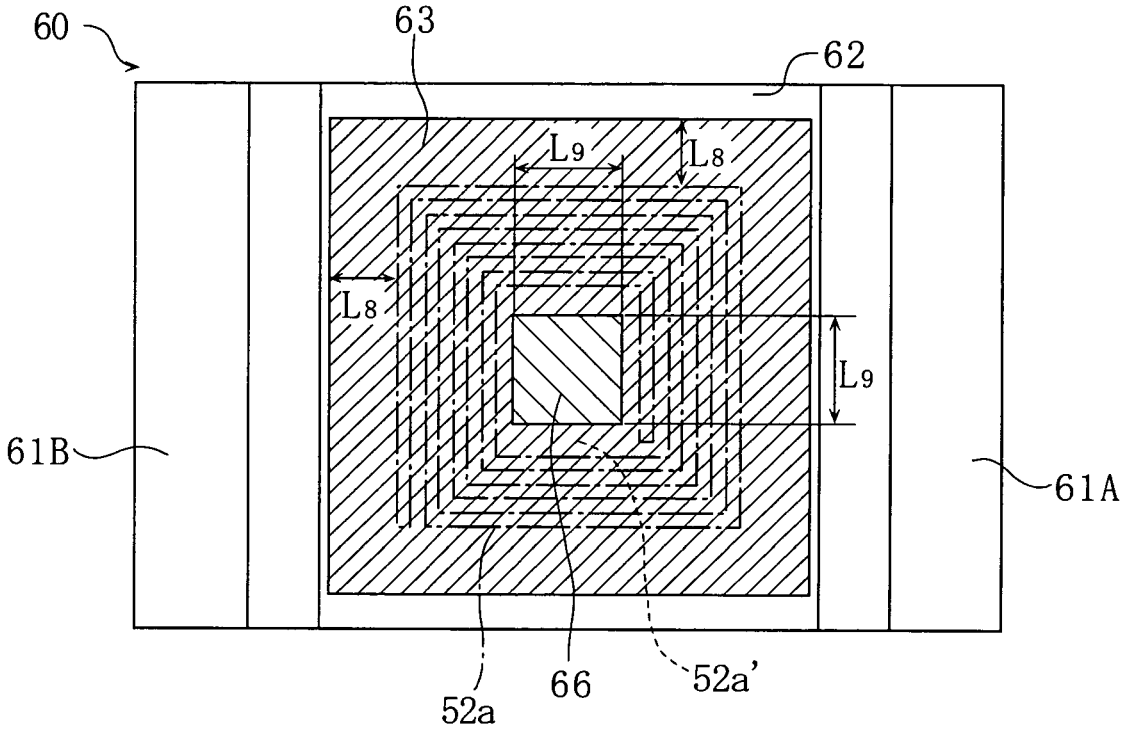
FIG. 16 is a bottom view of the movable structure according to the third embodiment.

As shown in FIG. 14 and FIG. 16, the movable structure 60 includes a pair of bonding legs 61A, 61B, a movable beam 62, an electroconductive film 63, a drive electrode 64, a terminal 65 and a projection 66. The bonding legs 61A, 61B are wider than the bonding legs 21A, 21B of the second fixed structure 20. The movable beam 62 bridges the bonding legs 61A, 61B, and is thinner than the bonding legs 61A, 61B. The electroconductive film 63 is patterned on a surface of the movable beam 62, and faces the coil 52*a* of the first fixed structure 50. The electroconductive film 63 extends in in-plane directions of the coil 52*a*, beyond the coil 52*a*. In an in-plane direction of the coil 12*a*, a distance $L_8$ indicated in FIG. 14 and FIG. 16, between an outermost edge of the electroconductive film 63 and an outermost edge of the coil 52*a* is e.g. 0 through 200 μm. The coil 52*a* is spaced from the electroconductive film 63 by a distance $d_5$, which is e.g. 0.2 through 2 μm when the movable beam 62 is in the natural state (when not in operation). The electroconductive film 63 as the above has a thickness of e.g. 1 through 10 μm. The drive electrode 64 is patterned on the other surface of the movable beam 62, and faces the drive electrode 23. The drive electrodes 23, 64 are spaced from each other by a distance $d_6$, which is e.g. 20 through 60 μm when the movable beam 62 is in the natural state. The terminal 65 is patterned on the same side as the drive electrode 64, on the movable beam 62 and the bonding leg 61A, and is electrically connected with the drive electrode 64. The terminal 65 extends to pass through the escape 21*a* of the bonding leg 21A in the second fixed structure 20. The terminal 65 as the above is electrically grounded via a predetermined wiring (not illustrated). The projection 66 is on the electroconductive film 63 to face the opening 52*a'* of the coil 52*a*, and partially in the recess 51*a* of the base substrate 51 in the first fixed structure 50 when the movable beam 62 is in the natural state. The projection 66 has a length $L_9$ as indicated in FIG. 16, which is e.g. 8 through 180 μm provided that the length is shorter than the length $L_7$. The bonding legs 61A, 61B and the movable beam 62 are made of a predetermined insulating material. The electroconductive film 63 is made of e.g. Al, Cu, Au and Ni. The drive electrode 64 and the terminal 65 are each made of a predetermined electroconductive material. The projection 66 is made of an electroconductive material or a dielectric material.

The variable inductor X3 being thus far described as the above, when a predetermined electrical potential is applied to the drive electrode 23 via the terminal 24 and the electroconductive plug 25, an electrostatic pull is generated between the drive electrodes 23, 64. The pull causes the movable beam 62 to deform elastically, coming closer to the fixed beam 22 thereby increasing the distance $d_5$ between the coil 52*a* and the electroconductive film 63. By adjusting the electric potential to be applied to the drive electrode 23, it is possible to control the electrostatic pull between the drive electrodes 23, 64, to control the amount of dislocation of the movable beam 62, and therefore to control the distance $d_5$ between the coil 52*a* and the electroconductive film 63.

In the variable inductor X3, when an electric current is applied to the conductor 52 via the terminals 52*b*, 52*c*, the current causes a magnetic field (a first magnetic field) to be generated around the coil 52*a*. The first magnetic field causes an induced current to flow in the electroconductive film 63, and the induced current causes a magnetic field (a second magnetic field) to be generated around the electroconductive film 63. The second magnetic field is formed to disturb the first magnetic field, i.e. to weaken the first magnetic field. In such an electromagnetic interference as the one between the coil 52*a* and the electroconductive film 63, the following is true; the shorter the distance $d_5$ between the coil 52*a* and the electroconductive film 63, the greater the induced current in the electroconductive film 63, the greater the second magnetic field, and therefore smaller the net magnetic field formed around the coil 52*a* (In other words, the longer the distance $d_5$, the smaller the induced current in the electroconductive film 63, the smaller the second magnetic field, and therefore greater the net magnetic field formed around the coil 52*a*). The smaller the net magnetic field formed around the coil 52*a* (i.e. shorter the distance $d_5$), the smaller the inductance between the terminals 52*b*, 52*c*: The greater the net magnetic field formed around the coil 12*a* (i.e. longer the distance $d_5$), the greater the inductance between the terminals 52*b*, 52*c*. Rate of change in such an inductance change tends to be greater than in e.g. the inductor X4 where inductance is changed by advancing/retracting movement of a magnetically highly permeable member with respect to the coil (Inductance of the variable inductor X3 can be adjusted by adjusting the distance $d_5$). The variable inductor X1 which has a large rate of change in its inductance is suitable for varying the inductance over a wide range.

In the variable inductor X3, the electroconductive film 63 extends in in-plane directions of the coil 52*a*, beyond the coil 52*a* as described earlier. Such an arrangement enables to generate the induced current appropriately in the electroconductive film 63, at a location faced by the coil 52*a*. Therefore, such an arrangement is suitable for achieving a large rate of inductance change.

In the variable inductor X3, the projection 66 which is made of an electroconductive material or a dielectric material is provided on the electroconductive film 63 on the side formed with the coil 52*a*. By selecting the shape and material of the projection, the rate of inductance change can be adjustable.

In the variable inductor X3, it is preferable that the electroconductive film 63 should have a thickness which is not smaller than a skin depth of the induced current generated in the electroconductive film 63 at the lowest frequency of the frequency range used in the variable inductor X3. Such an arrangement is suitable in generating the induced current appropriately in the electroconductive film 63 and to achieve a large rate of inductance change.

EXAMPLE 1

<<Variable Inductor Specifics>>

The variable inductor according to the present example is the variable inductor X1 which has the following specifics: The coil 12*a* is made of Cu, has a conductor width of 10 μm, a conductor thickness of 5 μm, a conductor-to-conductor distance of 10 μm, and a number of windings of three and three-quarters. The length $L_1$ indicated in FIG. 3 is 240 μm, and the length $L_2$ indicated in FIG. 3 is 100 μm. The electroconductive film 33 is made of Al, has a thickness of 5 μm, and is formed into a square shape whose length of the side is 2500 μm. The coil 12*a* faces the center of the electroconductive film 33. The distance $d_1$ between the coil 12*a* and the electroconductive film 33 is 1 μm when the movable beam 32 is in the natural state (when not operated).

<<Inductance>>

Figure 17:
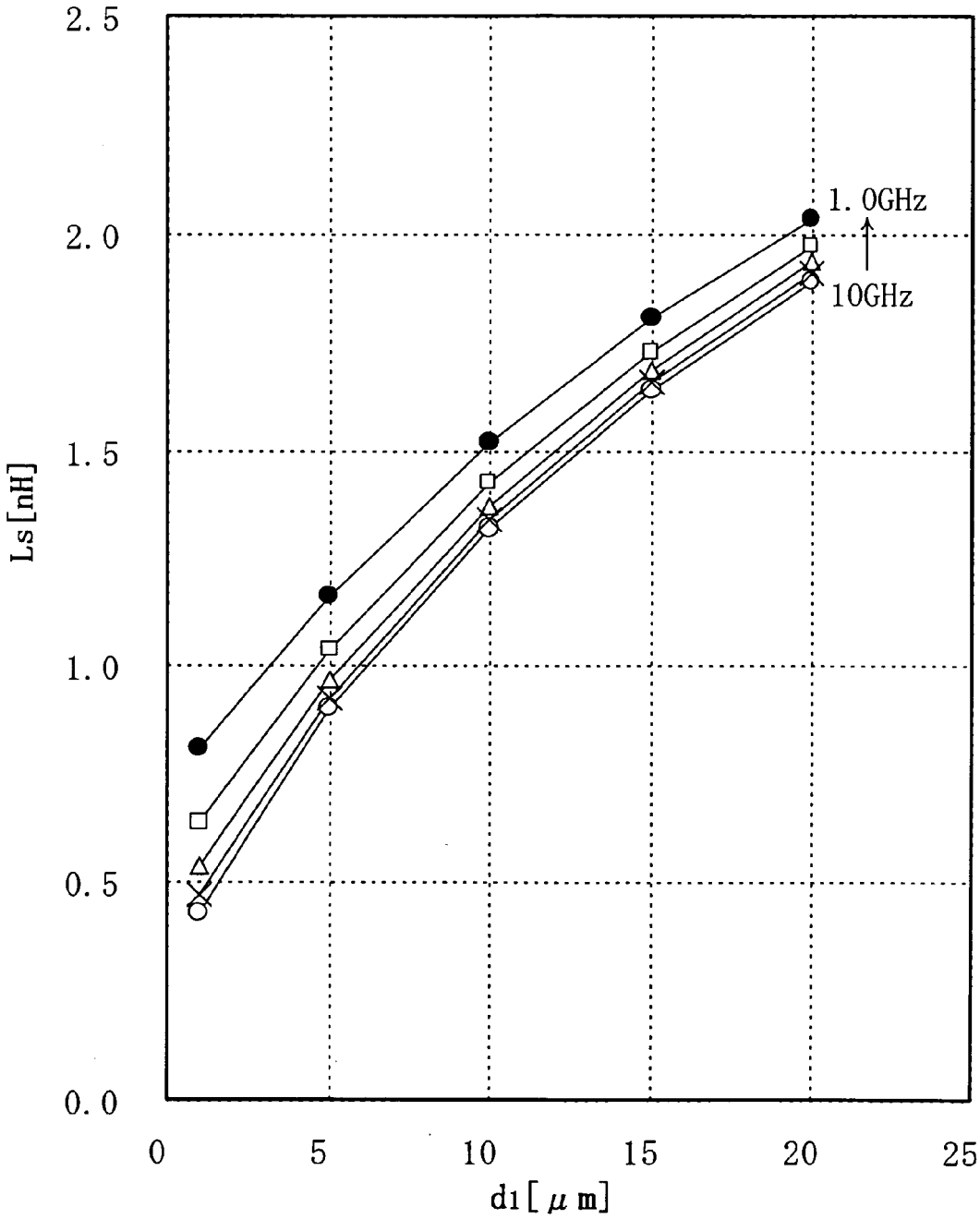
FIG. 17 is a graph showing how an inductance Ls changes in the variable inductor built as Example 1.
Figure 18:
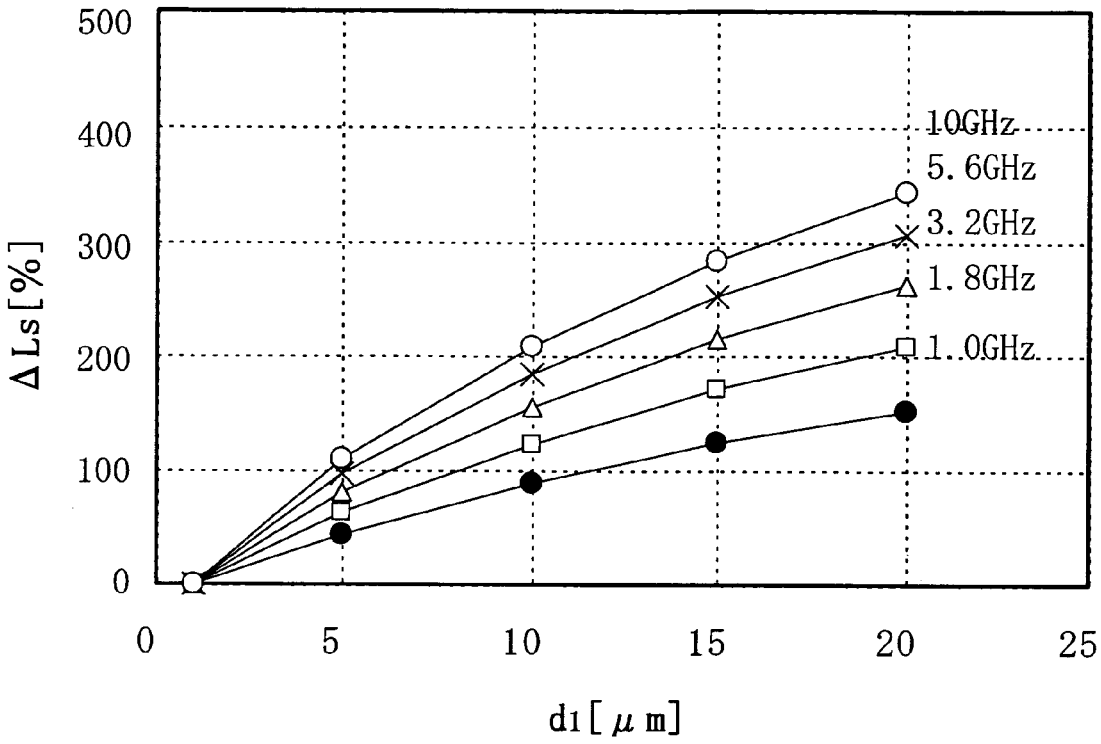
FIG. 18 is a graph showing how a rate of inductance change ΔLs changes in a variable inductor built as Example 1.

The variable inductor according to the present example underwent the following measurements: Specifically, AC currents of predetermined frequencies (1.0 GHz, 1.8 GHz, 3.2 GHz, 5.6 GHz and 10 GHz) were applied to the coil 12*a*, and the distance $d_1$ was varied to see changes in the inductance Ls [nH]. A result is shown as a graph in FIG. 17. Further, FIG. 18 is a graph which shows the rate of change ΔLs [%] of the inductance Ls. (The rate of change ΔLs [%] is the percentage of the amount of inductance change with respect to the inductance when the distance was the smallest.) In FIG. 17, the distance $d_1$ is represented by the horizontal axis of the graph whereas the inductance Ls is represented by the vertical axis (as is also the case in FIGS. 19 and 21 to be described later). Further, in FIG. 17, the graph plots changes in 1.0 GHz, 1.8 GHz, 3.2 GHz, 5.6 GHz and 10 Hz frequencies, using the symbols o, x, Δ, □ and ● respectively (as is also the case for graphs in FIGS. 18 through 22 to be described later). On the other hand, the graph in FIG. 18 uses the horizontal axis to represent the distance $d_1$ whereas the vertical axis represents the rate of change ΔLs (as is also the case in FIGS. 20 and 22).

EXAMPLE 2

<<Variable Inductor Specifics>>

The variable inductor according to the present example differs from the variable inductor according to Example 1 in that the electroconductive film 33 was given a thickness of 1 μm instead of 5 μm. Otherwise, the variable inductor in Example 2 is the same variable inductor X1 given the specifics utilized in Example 1.

<<Inductance>>

The variable inductor according to the present example underwent the following measurements: Specifically, AC currents of predetermined frequencies (1.0 GHz, 1.8 GHz, 3.2 GHz, 5.6 GHz and 10 GHz) were applied to the coil 12*a*, and the distance $d_1$ was varied to see changes in the inductance Ls [nH]. A result is shown as a graph in FIG. 19. Further, FIG. 20 is a graph which shows the rate of change ΔLs [%] of the inductance Ls.

EXAMPLE 3

<<Variable Inductor Specifics>>

The variable inductor according to the present example differs from the variable inductor according to Example 1 in that the electroconductive film 33 was given a thickness 0.2 μm instead of 5 μm. Otherwise, the variable inductor in Example 3 is the same variable inductor X1 given the specifics utilized in Example 1.

<<Inductance>>

The variable inductor according to the present example underwent the following measurements: Specifically, AC current of predetermined frequencies (1.0 GHz, 1.8 GHz, 3.2 GHz, 5.6 GHz and 10 GHz) were applied to the coil 12*a*, and the distance $d_1$ was varied to see changes in the inductance Ls [nH]. A result is shown as a graph in FIG. 21. Further, FIG. 22 is a graph which shows the rate of change ΔLs [%] of the inductance Ls.

EXAMPLE 4

<<Variable Inductor Specifics>>

The variable inductor according to the present example is the variable inductor X1 which has the following specifics: The coil 12*a* is made of Cu, has a conductor width of 10 μm, a conductor thickness of 5 μm, a conductor-to-conductor distance of 10 μm, and a number of windings of three and three-quarters. The length $L_1$ is 240 μm, and the length $L_2$ indicated in FIG. 3 is 100 μm. The electroconductive film 33 is made of Cu, has a thickness of 0.2 μm, and is formed into a square shape whose length of the side is 2500 μm. The coil 12*a* faces the center of the electroconductive film 33. The distance $d_1$ between the coil 12*a* and the electroconductive film 33 is 0.2 μm when the movable beam 32 is in the natural state (when not operated).

<<Inductance>>

Figure 23:
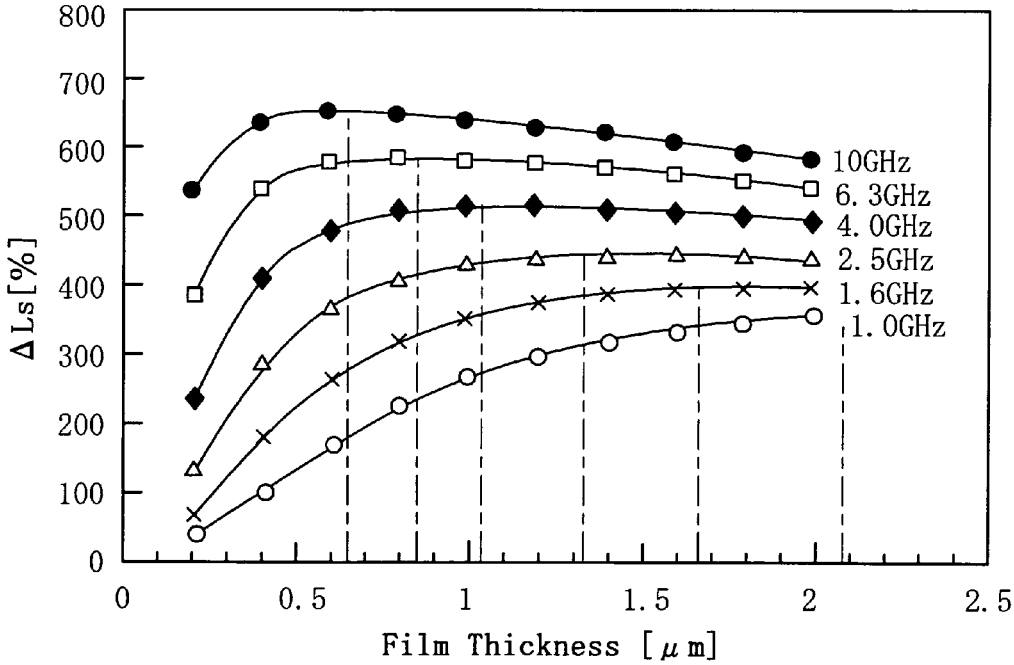
FIG. 23 is a graph showing dependency of the rate of inductance change ΔLs on an electroconductive film thickness for Examples 4 through 13 at different frequencies.

The variable inductor according to the present example underwent the following measurements: Specifically, AC currents of predetermined frequencies (1.0 GHz, 1.6 GHz, 2.5 GHz, 4.0 GHz, 6.3 GHz and 10 GHz) were applied to the coil 12*a*, and the distance $d_1$ was varied to see changes in the inductance Ls [nH]. FIG. 23 shows a graph which plots the rate of change ΔLs [%] of the inductance Ls when the distance $d_1$ was 50 μm, with respect to the inductance Ls when the distance $d_1$ was 0.2 μm. In the graph in FIG. 23, the horizontal axis represents the electroconductive film thickness [μm] whereas the vertical axis represents the rate of change ΔLs. Further, in FIG. 23, the graph plots changes in 1.0 GHz, 1.6 GHz, 2.5 GHz, 4.0 GHz, 6.3 GHz and 10 GHz frequencies, using symbols o, x, Δ, ♦, □ and ● respectively. In the present Example, a plotting interval on the horizontal axis is 0.2. In addition, the graph in FIG. 23 shows the skin depth (theoretically calculated values) of the induced current generated in the Cu film (electroconductive film 33) at each of the frequencies (1.0 GHz, 1.6 GHz, 2.5 GHz, 4.0 GHz, 6.3 GHz and 10 GHz) in dashed lines each indicating a point on the horizontal axis. The leftmost dashed line is for 1.0 GHz, the second dashed line from the left is for 1.6 GHz, the third dashed line from the left is for 2.5 GHz, the fourth dashed line from the left is for 4.0 GHz, the second dashed line from the right is for 6.3 GHz and the rightmost dashed line is for 10 GHz.

EXAMPLES 5 THROUGH 13

<<Variable Inductor Specifics>>

Variable inductors according to Examples 5 through 13 differ from the variable inductor X1 according to Example 4 in that the electroconductive film 33 is altered from 5 μm to 0.4 μm (Example 5), 0.6 μm (Example 6), 0.8 μm (Example 7), 1.0 μm (Example 8), 1.2 μm (Example 9), 1.4 μm (Example 10), 1.6 μm (Example 11), 1.8 μm (Example 12) or 2.0 μm (Example 13). Otherwise, the variable inductors are the same variable inductor X1 given the specifics utilized in Example 4.

<<Inductance>>

The variable inductors according to Examples 5 through 13 underwent the following measurements: Specifically, AC currents of predetermined frequencies (1.0 GHz, 1.6 GHz, 2.5 GHz, 4.0 GHz, 6.3 GHz, 10 GHz) were applied to the coil 12*a*, and the distance $d_1$ was varied to see changes in the inductance Ls [nH]. FIG. 23 shows a graph which plots the rate of change ΔLs [%] of the inductance Ls when the distance $d_1$ was 50 μm, with respect to the inductance Ls when the distance $d_1$ was 0.2 μm. The plotting interval on the horizontal axis is 0.4 in e.g. Example 5, while the plotting interval on the horizontal axis is 1.4 in e.g. Example 10.

EXAMPLE 14

<<Variable Inductor Specifics>>

The variable inductor according to the present example is the variable inductor X2 which has the following specifics: The coil 12*a* is made of Cu, has a conductor width of 10 μm, a conductor thickness of 5 μm, a conductor-to-conductor distance of 10 μm, a number of windings of three and three-quarters. The length $L_1$ (shown in FIG. 3 as in relation with the first embodiment) is 240 μm, and the length $L_2$ (shown in FIG. 3 as in relation with the first embodiment) is 100 μm. The electroconductive film 43 is made of Al, has a thickness of 0.8 μm, and is formed into a square shape whose length of the side is 2500 μm. The coil 12*a* faces the center of the electroconductive film 33. The distance $L_4$ indicated in FIG. 12 and FIG. 13 as a distance between the outermost edge of the electroconductive film 43 and the outermost edge of the coil 12*a* in an in-plane direction of the coil 12*a* is 1130 μm. The distance $L_5$ indicated in FIG. 13 as a distance between the innermost edge of the electroconductive film 43 and the innermost edge of the coil 12*a* in an in-plane direction of the coil 12*a* is 10 μm. The distance $d_3$ between the coil 12*a* and the electroconductive film 43 is 1 μm when the movable beam 42 is in the natural state (when not operated).

<<Inductance>>

Figure 24:
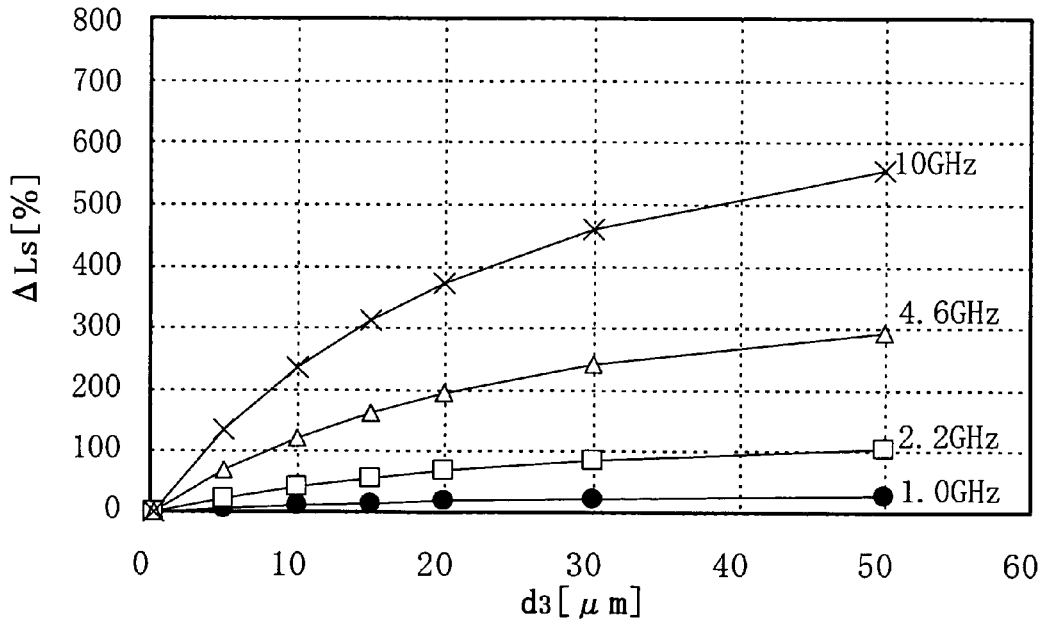
FIG. 24 is a graph showing how the rate of inductance change ΔLs changes in a variable inductor built as Example 14.

The variable inductor according to the present example underwent the following measurements: Specifically, AC currents of predetermined frequencies (1.0 GHz, 2.2 GHz, 4.6 GHz and 10 GHz) were applied to the coil 12*a*, and the distance $d_3$ was varied to see changes in the inductance Ls [nH]. FIG. 24 is a graph which shows the rate of change ΔLs [%] of the inductance Ls. In FIG. 24, the distance $d_3$ is represented by the horizontal axis of the graph whereas the rate of change ΔLs is represented by the vertical axis (as is also the case for graphs in FIG. 25 through 32). Further, in FIG. 24, the graph plots changes in 1.0 GHz, 2.2 GHz, 4.6 GHz and 10 GHz, using the symbols ●, □, Δ and x respectively (as is also the case for graphs in FIG. 25 through 29).

EXAMPLE 15

<<Variable Inductor Specifics>>

The variable inductor according to the present example is the variable inductor X2 which has the following specifics: The coil 12*a* is made of Cu, has a conductor width of 10 μm, a conductor thickness of 5 μm, has a conductor-to-conductor distance of 10 μm, and a number of windings of three and three-quarters. The length $L_1$ (shown in FIG. 3 as in relation with the first embodiment) is 240 μm. The length $L_2$ (indicated in FIG. 3 as in relation with the first embodiment) is 100 μm. The electroconductive film 43 is made of Al, has a thickness of 5 μm, and is formed into a square shape whose length of the side is 260 μm. The coil 12*a* faces the center of the electroconductive film 43. The distance $L_4$ indicated in FIG. 12 and FIG. 13 as a distance between the outermost edge of the electroconductive film 43 and the outermost edge of the coil 12*a* in an in-plane direction of the coil 12*a* is 10 μm. The distance $L_5$ indicated in FIG. 13 as a distance between the innermost edge of the electroconductive film 43 and the innermost edge of the coil 12*a* in an in-plane direction of the coil 12*a* is 10 μm. The distance $d_3$ between the coil 12*a* and the electroconductive film 43 is 1 μm when the movable beam 42 is in a natural state (when not operated).

<<Inductance>>

Figure 25:
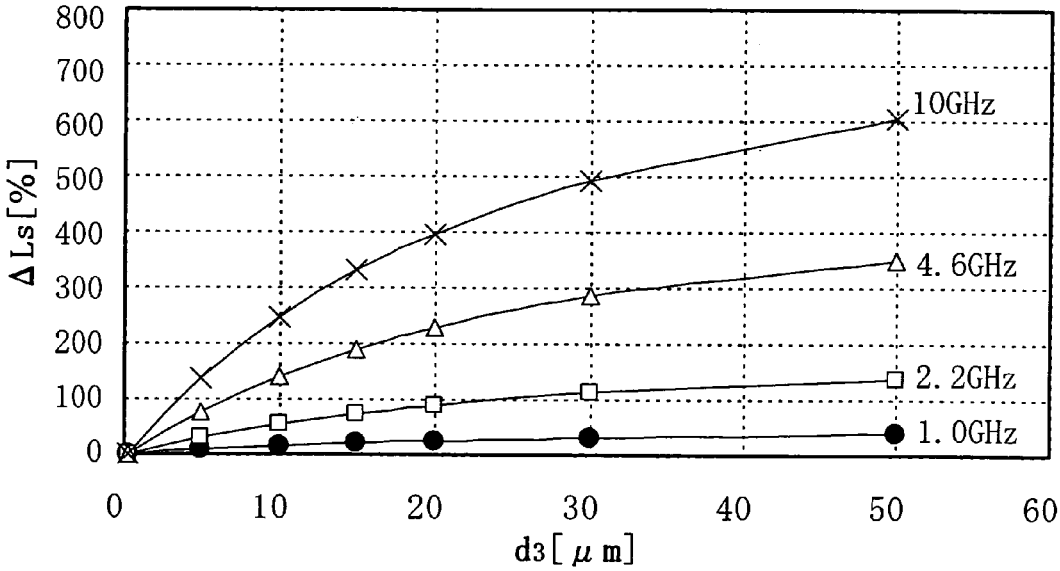
FIG. 25 is a graph showing how the rate of inductance change ΔLs changes in a variable inductor built as Example 15.

The variable inductor according to the present example underwent the following measurements: Specifically, AC currents of predetermined frequencies (1.0 GHz, 2.2 GHz, 4.6 GHz and 10 GHz) were applied to the coil 12*a*, and the distance $d_3$ was varied to see changes in the inductance Ls [nH]. FIG. 25 is a graph which shows the rate of change ΔLs [%] of the inductance Ls.

EXAMPLE 16

<<Variable Inductor Specifics>>

The variable inductor according to the present example differs from the variable inductor X2 according to Example 15 in that the distance $L_4$ indicated in FIG. 12 and FIG. 13 was altered from 10 μm to 0 μm. Otherwise, the variable inductor in Example 16 is the same variable inductor X2 given the specifics utilized in Example 15.

<<Inductance>>

Figure 26:
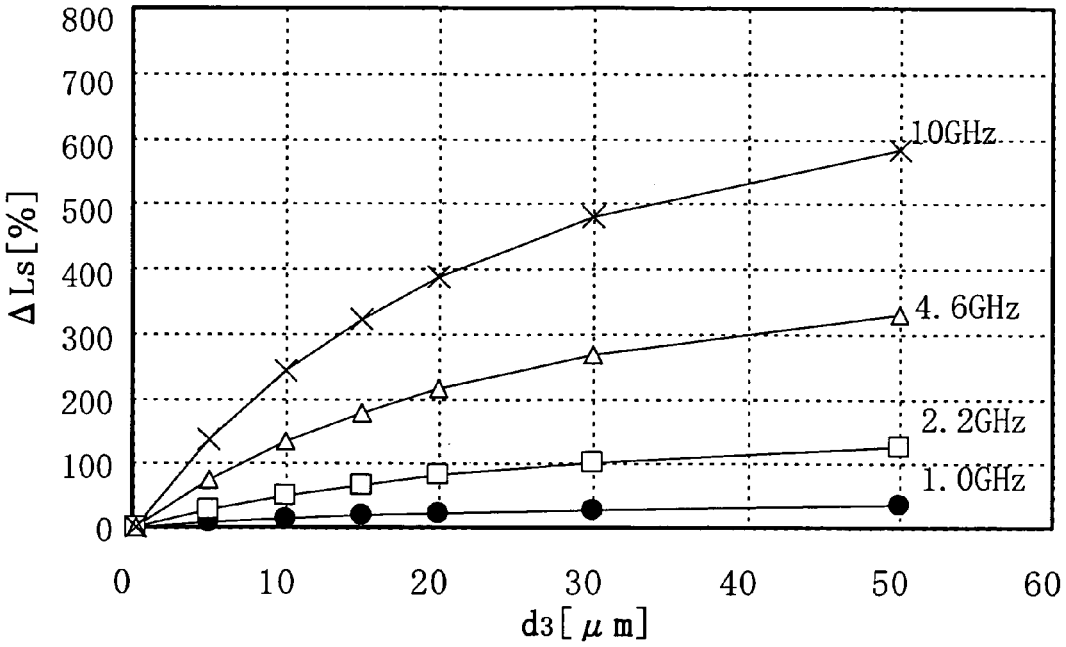
FIG. 26 is a graph showing how the rate of inductance change ΔLs changes in a variable inductor built as Example 16.

The variable inductor according to the present example underwent the following measurements: Specifically, AC currents of predetermined frequencies (1.0 GHz, 2.2 GHz, 4.6 GHz and 10 GHz) were applied to the coil 12*a*, and the distance $d_3$ was varied to see changes in the inductance Ls [nH]. FIG. 26 is a graph which shows the rate of change ΔLs [%] of the inductance Ls.

EXAMPLE 17

<<Variable Inductor Specifics>>

The variable inductor according to the present example differs from the variable inductor according to Example 15 based on the variable inductor X2 in that the distance $L_4$ indicated in FIG. 12 and FIG. 13 was altered from 10 μm to minus 10 μm. In addition, in the present variable inductor, part of the outermost edge of the coil does not face the electroconductive film.

<<Inductance>>

Figure 27:
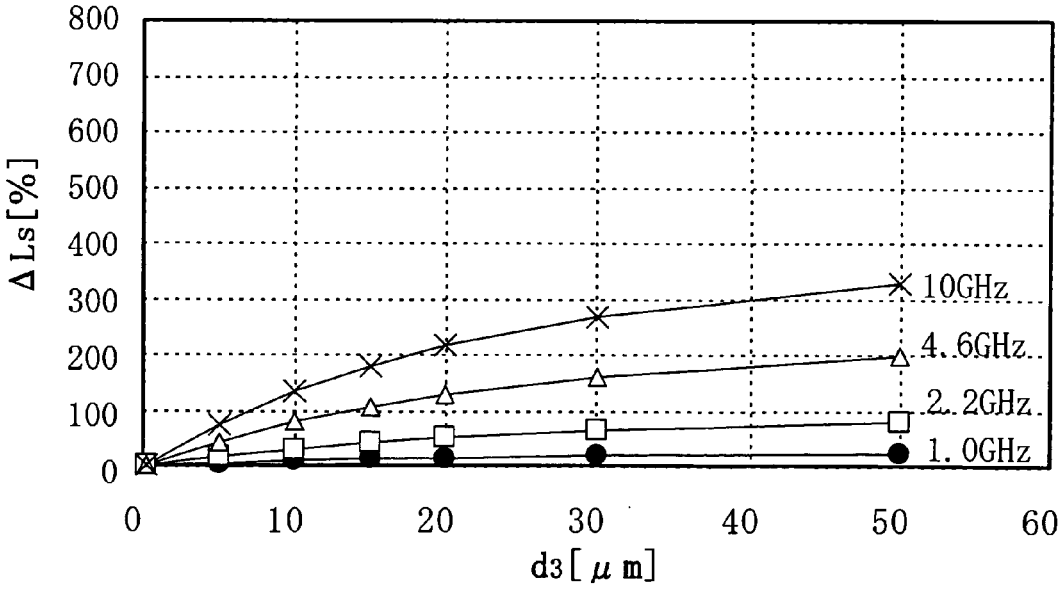
FIG. 27 is a graph showing how the rate of inductance change ΔLs changes in a variable inductor built as Example 17.

The variable inductor according to the present example underwent the following measurements: Specifically, AC currents of predetermined frequencies (1.0 GHz, 2.2 GHz, 4.6 GHz and 10 GHz) were applied to the coil 12*a*, and the distance $d_3$ was varied to see changes in the inductance Ls [nH]. FIG. 27 is a graph which shows the rate of change ΔLs [%] of the inductance Ls.

EXAMPLE 18

<<Variable Inductor Specifics>>

The variable inductor according to the present example differs from the variable inductor X2 according to Example 15 only in that the distance $L_5$ indicated in FIG. 13 was altered from 10 μm to 0 μm.

<<Inductance>>

Figure 28:
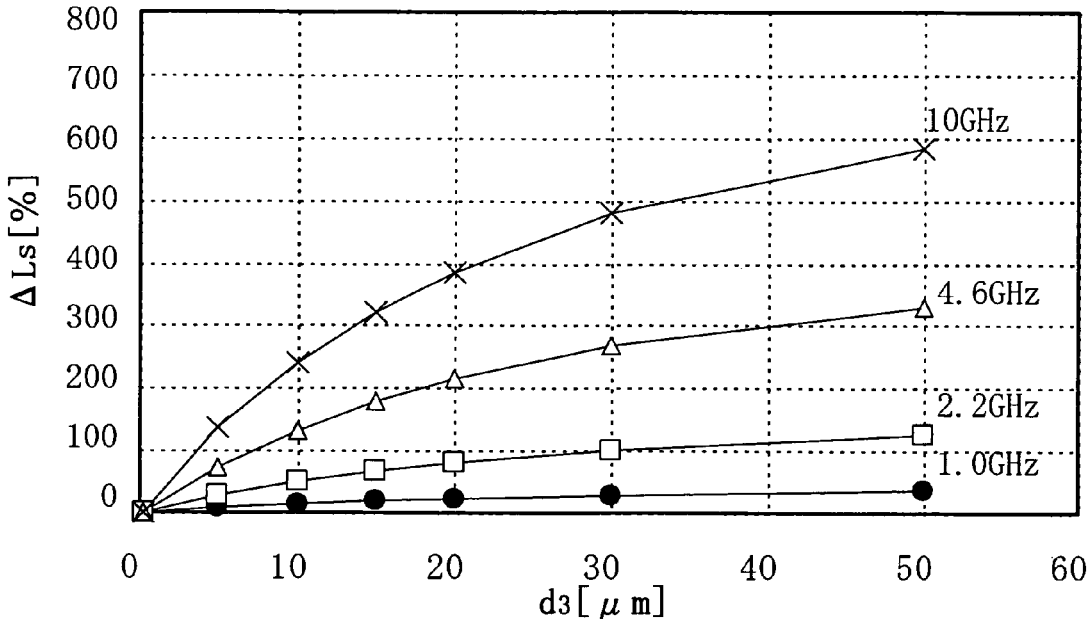
FIG. 28 is a graph showing how the rate of inductance change ΔLs changes in a variable inductor built as Example 18.

The variable inductor according to the present example underwent the following measurements: Specifically, AC currents of predetermined frequencies (1.0 GHz, 2.2 GHz, 4.6 GHz and 10 GHz) were applied to the coil 12*a*, and the distance $d_3$ was varied to see changes in the inductance Ls [nH]. FIG. 28 is a graph which shows the rate of change ΔLs [%] of the inductance Ls.

EXAMPLE 19

<<Variable Inductor Specifics>>

The variable inductor according to the present example differs from the variable inductor according to Example 15 based on the variable inductor X2 in that the distance $L_5$ indicated in FIG. 13 was altered from 10 μm to minus 10 μm. In addition, in the present variable inductor, part of the innermost edge of the coil does not face the electroconductive film.

<<Inductance>>

Figure 29:
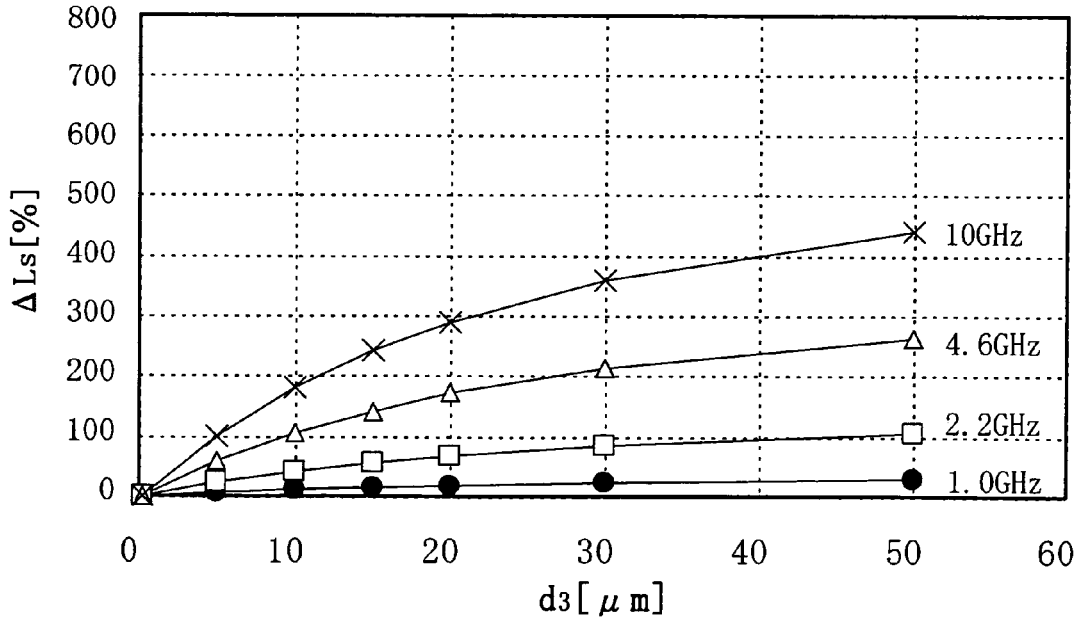
FIG. 29 is a graph showing how the rate of inductance change ΔLs changes in a variable inductor built as Example 19.
Figure 30:
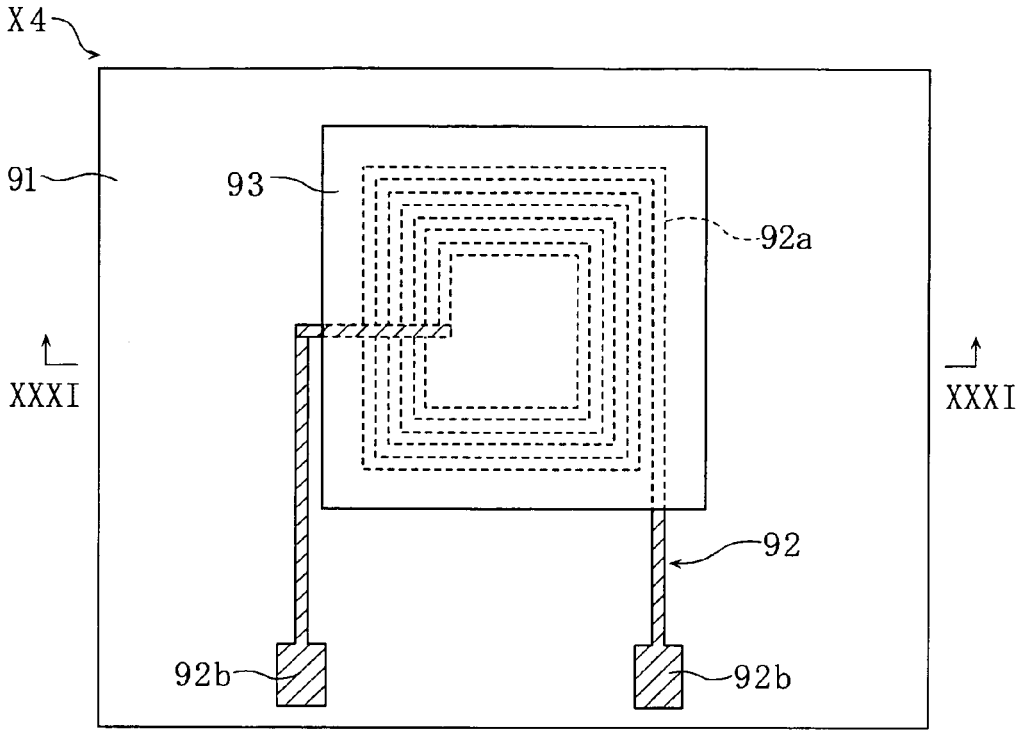
FIG. 30 Prior Art
FIG. 30 is a plan view of a conventional variable inductor.
Figure 31:
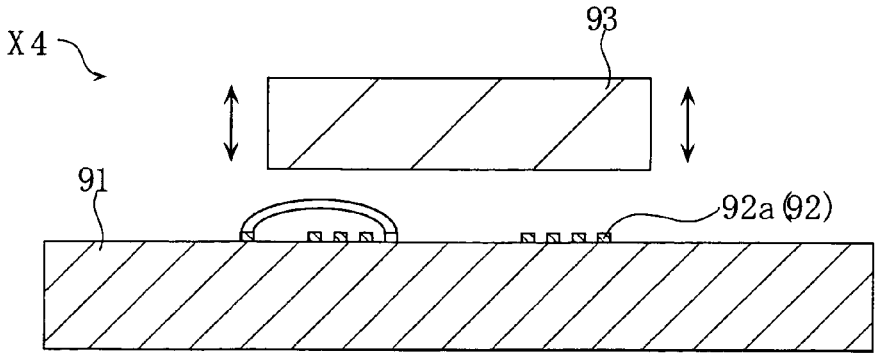
FIG. 31 Prior Art
FIG. 31 is a sectional view taken in lines XXXI—XXXI in FIG. 30.

The variable inductor according to the present example underwent the following measurements: Specifically, AC currents of predetermined frequencies (1.0 GHz, 2.2 GHz, 4.6 GHz, 10 GHz) were applied to the coil 12*a*, and the distance $d_3$ was varied to see changes in the inductance Ls [nH]. FIG. 29 is a graph which shows the rate of change ΔLs [%] of the inductance Ls.

<Evaluation>

Figure 19:
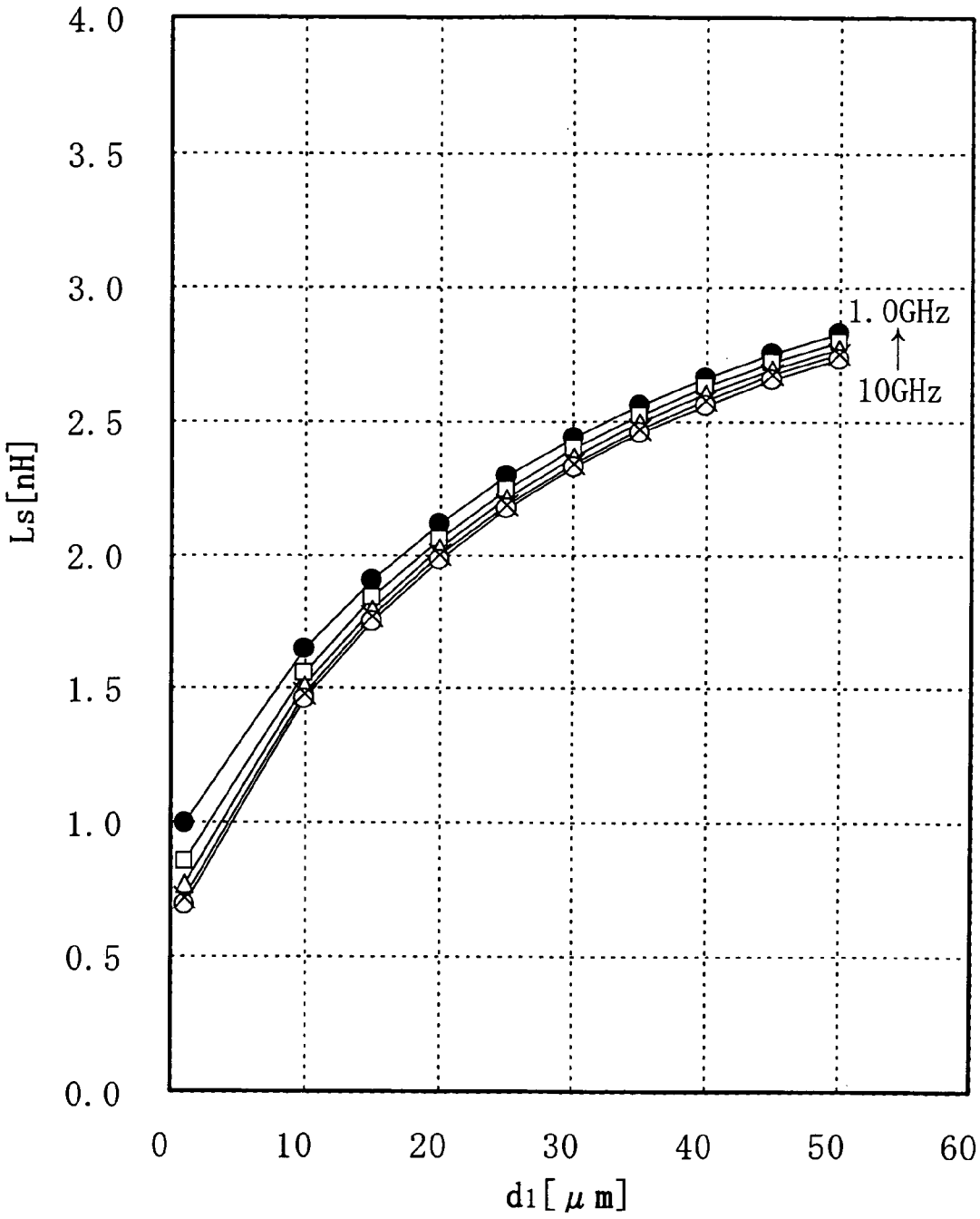
FIG. 19 is a graph showing how an inductance Ls changes in a variable inductor build as Example 2.
Figure 20:
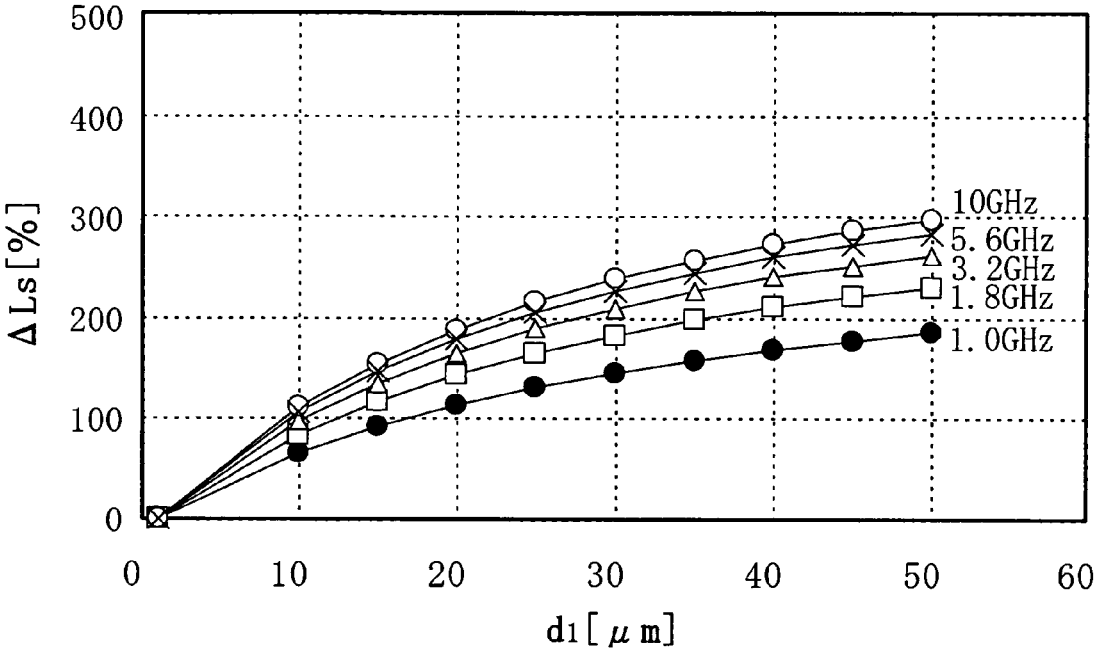
FIG. 20 is a graph showing how the rate of inductance change ΔLs changes in a variable inductor built as Example 2.
Figure 21:
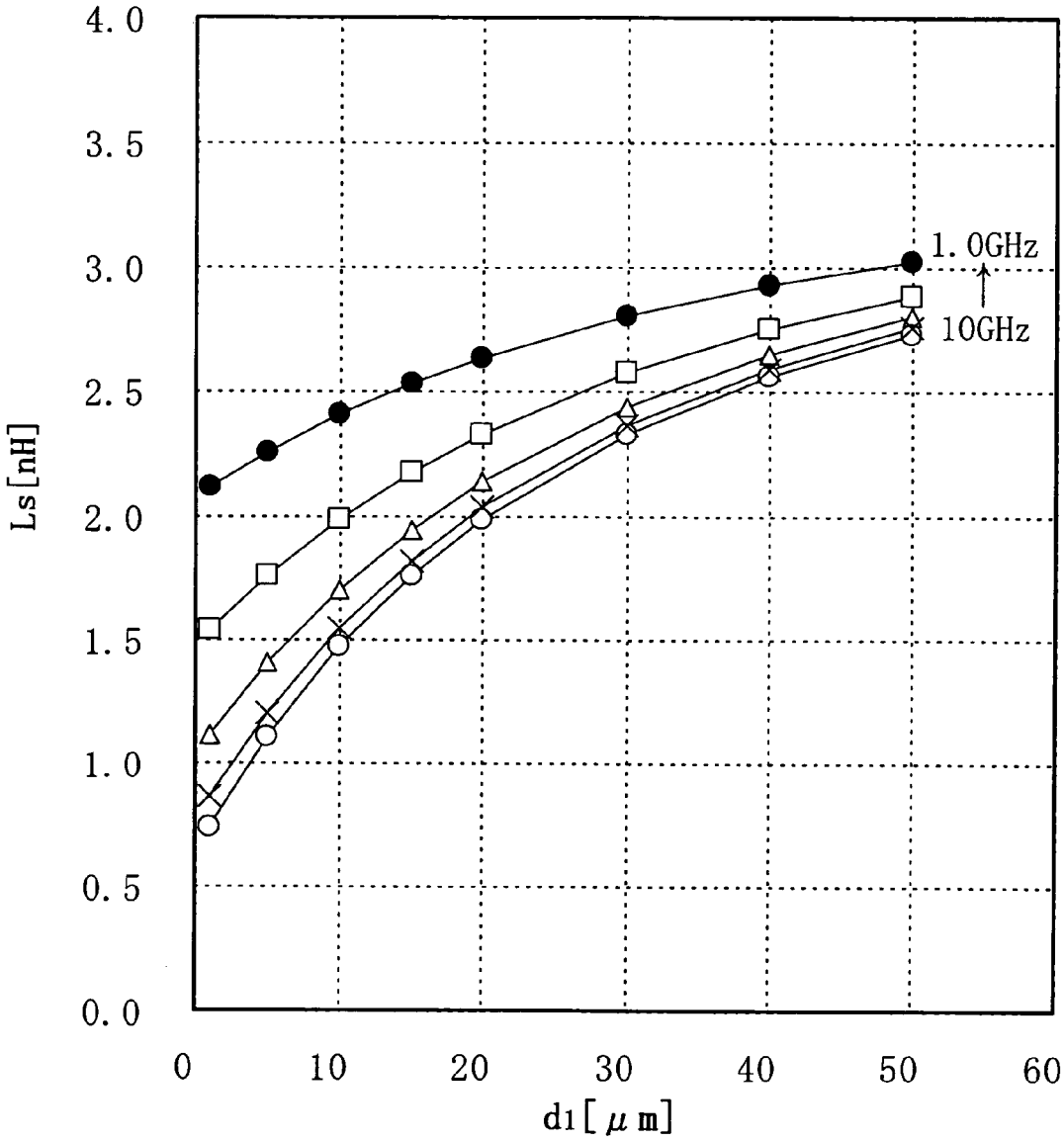
FIG. 21 is a graph showing how the inductance Ls changes in a variable inductor build as Example 3.
Figure 22:
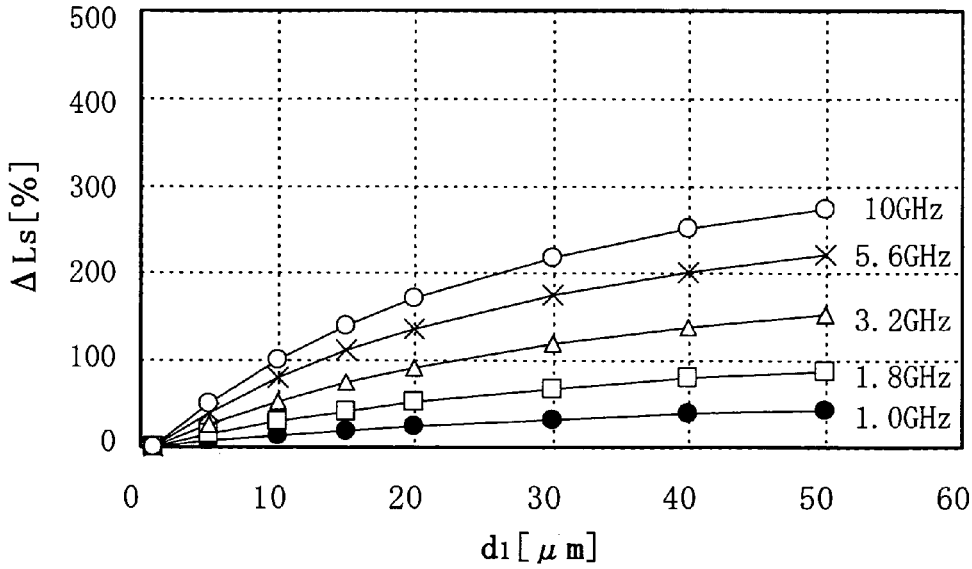
FIG. 22 is a graph showing how the rate of inductance change ΔLs changes in a variable inductor built as Example 3.

From the graphs in FIGS. 17, 19 and 21 (Examples 1 through 3), it is clear that the inductance Ls becomes greater as the distance $d_1$ becomes greater. From the graphs in FIGS. 18, 20 and 22 (Examples 1 through 3), it is clear that the rate of change ΔLs of the inductance becomes higher as the frequency of AC current passing through the coil 12*a* becomes higher. For example, when the frequency is 10 GHz, the rate of change ΔLs can be as high as 400%. Further, comparison between the graph in FIG. 20 (Example 2) and the graph in FIG. 22 (Example 3) shows that the variable inductor according to Example 2 whose electroconductive film 33 is thicker than is the electroconductive film 33 of the variable inductor according to Example 3 tend to have a greater rate of change ΔLs particularly in a lower frequency range than the counterpart. This is probably because the electroconductive film 33 (Al film) in Example 2 has a sufficient thickness as deep as or deeper than the skin depth of the induced current in the low frequency range whereas the electroconductive film 33 (Al film) in Example 3 does not have a sufficient thickness.

As shown graphically in FIG. 23, if the electroconductive film 33 has a thickness not thinner than the skin depth in each frequency, the rate of change ΔLs of the inductance is essentially saturated. The skin depth becomes bigger as the frequency becomes higher. Therefore, in the variable inductor according to the present invention, the electroconductive film which faces the coil preferably has a thickness not thinner than a skin depth for the lowest frequency in the frequency range to be used by the inductor so that an induced current can be generated appropriately in the electroconductive film for achieving a large rate of inductance change or a large inductance.

Comparison between the graph in FIG. 18 (Example 1) and the graph in FIG. 24 (Example 14) shows that the variable inductor according to Example 14 whose electroconductive film 43 has an opening 43*a* tends to have a greater rate of change ΔLs particularly in a high frequency range than the variable inductor according to Example 1 whose electroconductive film 33 does not have an opening. This is probably because the induced current is generated more intensively and efficiently in the electroconductive film 43 in Example 14, at the place faced by the coil 12*a*, than in the electroconductive film 33 in Example 1.

Comparison among the graphs in FIGS. 25 through 27 (Examples 15, 16 and 17) shows that the variable inductors according to Examples 15 and 16 whose electroconductive films 43 extend in in-plane directions of the coil 12*a* beyond the coil 12*a* exhibit a greater rate of inductance change ΔLs particularly in a lower frequency range than the variable inductor according to Example 17 whose electroconductive film does not extend beyond the coil.

Comparison among the graphs in FIGS. 25, 28 and 29 (Examples 15, 18 and 19) shows that the variable inductors according to Examples 15 and 18 whose electroconductive films 43 have an opening 43*a* located within the opening 12*a'* of the coil 12*a* as in an in-plane direction of the coil 12*a* exhibit a greater rate of inductance change ΔLs particularly in a higher frequency range than the variable inductor according to Example 19 whose opening is not located within the opening.

The invention claimed is:

1. A variable inductor comprising:

a conductor including a coil and a pair of terminals electrically connected with the coil; and an electroconductive member movable closer to and farther away from the coil;

wherein an inductance between the terminals becomes smaller as a distance between the coil and the electroconductive member becomes shorter, and wherein the inductance between the terminals becomes larger as the distance between the coil and the electroconductive member becomes longer.

2. The variable inductor according to claim 1, wherein the coil is provided by a flat spiral coil, the electroconductive member being provided by an electroconductive film or an electroconductive plate that is spaced from the flat spiral coil in a thickness direction of the flat spiral coil but arranged to face the flat spiral coil.

3. The variable inductor according to claim 2, wherein the electroconductive member extends in an in-plane direction of the flat spiral coil and beyond the flat spiral coil.

4. The variable inductor according to claim 2, wherein the flat spiral coil includes a center opening, the electroconductive member including an opening at a place corresponding to the center opening.

5. The variable inductor according to claim 4, wherein the opening in the electroconductive member is within the center opening of the flat spiral coil as in an in-plane direction of the flat spiral coil.

6. The variable inductor according to one of claim 1, wherein the flat spiral coil includes a center opening, the electroconductive member including a region corresponding to the center opening and provided with a projection.

7. The variable inductor according to claim 6, wherein the projection is made of an electroconductive material or a dielectric material.

8. The variable inductor according to one of claim 1, wherein the electroconductive member is thicker than a skin depth of an induced current generated in the electroconductive member at the lowest frequency of a frequency range utilized.

9. The variable inductor according to one of claim 1, wherein the coil is made of one of Au, Cu, Al and Ni.

* * * * *